US005566741A

United States Patent [19]

Ogawara et al.

[11] Patent Number: 5,566,741

[45] Date of Patent: Oct. 22, 1996

[54] ROLL SCREEN APPARATUS

[75] Inventors: Takeshi Ogawara; Yukinori Chisaka; Masato Fujihara, all of Tokyo, Japan

[73] Assignee: Kabushiki Kaisha Nichibei, Tokyo, Japan

[21] Appl. No.: 250,119

[22] Filed: May 26, 1994

[30] Foreign Application Priority Data

| | | | |
|---|---|---|---|
| Jun. 2, 1993 | [JP] | Japan | 5-156260 |
| Jun. 16, 1993 | [JP] | Japan | 5-169656 |
| Jul. 8, 1993 | [JP] | Japan | 5-193052 |
| Feb. 24, 1994 | [JP] | Japan | 6-053079 |

[51] Int. Cl.[6] ..... E06B 9/56

[52] U.S. Cl. ..... 160/297; 160/308

[58] Field of Search ..... 160/321, 297, 160/307, 308, 305, 291, 309, 319, 323.1; 192/415

[56] References Cited

U.S. PATENT DOCUMENTS

| | | | |
|---|---|---|---|
| 4,305,447 | 12/1981 | Persson | 160/297 |
| 4,345,636 | 8/1982 | Fukuchi | 160/297 |
| 4,751,953 | 6/1988 | Appel et al. | 160/321 X |
| 4,779,662 | 10/1988 | Wilk | 160/321 |
| 4,865,109 | 9/1989 | Sherman | 160/321 |
| 5,099,906 | 3/1992 | Chigusa et al. | 160/297 |
| 5,375,643 | 12/1994 | Rude | 160/321 |

FOREIGN PATENT DOCUMENTS

| | | |
|---|---|---|
| 0356403 | 2/1990 | European Pat. Off. . |
| 655544 | 4/1986 | Switzerland . |
| 2126637 | 3/1984 | United Kingdom . |

*Primary Examiner*—David M. Purol
*Attorney, Agent, or Firm*—Anderson, Kill & Olick P.C.

[57] ABSTRACT

A roll screen apparatus improved in operation and manufacturing, wherein the winding up and down of the roll screen are effected in such a manner so that the rotation of the pulley, by the pulling down of the operation cord, is transmitted to the screen winding pipe, and wherein the stop of the screen is effected by disengaging the transmission from the screen winding pipe to the pulley. The improved apparatus is characterized by providing a clutch device and a disengagement device. The clutch device is only transmissive of the rotation of the pulley to the screen winding pipe, and the disengagement device disconnects the engagement between the pulley and the screen winding pipe and maintains such disconnected condition.

1 Claim, 32 Drawing Sheets

524

ROLL SCREEN APPARATUS

BACKGROUND OF THE INVENTION

1. Field of the Invention

The present invention relates to a roll screen apparatus.

2. Description of the Related Art

A conventional roll screen apparatus which is disclosed in Japanese Patent Application No. Hei 4-80493 comprises a screen-winding axle equipped with an energizing means to apply a rotating force to the screen-winding axle for winding up a screen hanging therefrom, a pulley having an associated operation cord, and a clutch device responsive to the unwinding of the screen by pulling the operation cord for transmitting rotation of the pulley to the screen-winding axle, and responsive to the pulling-down of the operation cord subsequent to the screen-unwinding operation for permitting the energizing means to apply the rotating force to the screen-winding axle, thereby rotating the screen-winding axle to wind up the screen thereon.

The clutch device comprises: a clutch casing fixed to the middle of the support axle so as to permit rotation thereabout but prevent axial displacement therealong, the clutch casing having the output shaft of the pulley fixed thereto, to permit no relative rotation therebetween; a first clutch drum rotatably supported by to the middle of the support axle within the clutch casing; a coil spring connected at one end to the clutch casing and at the other end to the first clutch drum; a second clutch drum provided to the circumference of the base portion of the first clutch drum; a slide groove made on the inner circumference of the clutch casing; a clutch ball between a first guide groove made on the outer circumference of the first clutch drum and a second groove made on the forward end of the second clutch drum, the ball being movable along with rotation of the clutch casing; a brake drum rotatably supported by the middle of the support axle; a brake carrier rotatably supported on the inner circumference of the brake drum, the forward end of the brake carrier being connectable to the first clutch drum; a stop ring fitted on the middle of the support axle, and supported at one end by the brake carrier and at the other end by the first clutch drum; a brake spring fitted on the inner circumference of the brake drum; a coil spring fitted on the outer circumference of the brake drum; and an operation cap extending from the forward end of the clutch case to the base portion of the brake drum to cover the whole length, the forward end of the operation cap being rotatably supported by the forward end of the clutch casing through the agency of bearings, and one end of the coiled spring being connected to the operation cap, the outer circumference of which operation cap has the screen-winding pipe provided thereon.

When it is desired that the screen is unwound, the pulley is rotated in the screen-unwinding direction, thereby permitting the clutch casing to rotate against the energizing force of the coil spring thus to move the clutch ball. Then, rotation of the clutch casing is transmitted to the first clutch drum via the rotating clutch ball, thereby expanding radially the stop spring until it is allowed to rotate about the support axle along with the first clutch drum, and therefore, the first clutch drum presses against the brake carrier until it rotates, causing the brake spring to expand radially. Thus, the brake drum rotates together, permitting the screen-winding axle to rotate through the operation cap.

When it is desired that the screen is wound up, the pulley is rotated in the screen-unwinding direction, thereby permitting the clutch casing to rotate against the energizing force of the coiled spring thus to move the clutch ball. Then, rotation of the clutch casing is transmitted to the second clutch drum via the rotating clutch ball, thereby allowing the second clutch drum to press against the end of the brake ring until it rotates in the screen-unwinding direction. Rotation of the brake ring is transmitted to the brake carrier via the brake spring, and accordingly the friction between the support axle and the stop spring increases until the brake carrier is fixed to the support axle. While one end of the brake spring is fixed to the brake carrier, the other end of the brake carrier is increasingly pressed to cause radial reduction of the brake spring, accordingly lowering the friction between the brake spring and the brake drum until the brake drum is permitted to rotated with respect to the brake spring. Then, the screen-winding axle is allowed to rotate under the influence of resilience stored in the coil spring, thereby winding up the screen.

Likewise, a roll screen apparatus disclosed in Japanese Patent Application Laid-Open No. Hei 4-149390 includes a screen-winding axle having a screen to be wound and unwound therefrom, an energizing means to apply a rotating force to the screen-winding axle for winding up the screen hanging therefrom, a pulley operatively connected to the screen-winding axle for rotating it, and an associated operation cord for rotating the pulley. When it is desired that the screen is unwound from the screen-winding axle, the unwinding or "down" side of the operation cord is pulled down to tighten an associated clutch spring, thereby connecting the pulley to the screen-winding axle for transmitting rotation of the pulley to the screen-winding axle. When it is desired that the screen is wound on the screen-winding axle, the winding or "up" side of the operation cord is pulled down to rotate the pulley in the direction in which the screen is wound on the screen-winding axle, thereby loosening the clutch spring to disconnect the pulley from the screen-winding axle. Then, the screen-winding axle is allowed to rotate and wind up the screen by the self-contained energizing means.

The roll screen apparatus of Japanese Patent Publication No. Sho 63-46224 requires alternate and repetitive succession of pulling-down and winding-up of the cord. This operation causes inconvenience.

The roll screen apparatus to Japanese Patent Application Laid-Open No. Hei 4-80493 uses a clutch device, which is composed of numerous parts, and is complicated in structure. Accordingly, the assembling work cannot be simplified and the efficiency of labor is not good, requiring high production cost.

These conventional roll screen apparatuses use a clutch spring responsive to application of a rotation force to the pulley for disconnecting the pulley from the screen-winding axle against the resilient force of the energizing means. This necessitates increased resilient force of the energizing means with increase in the screen size, and accordingly the counter resilient force of the clutch spring must be increased. The rotating force to be applied to the pulley, therefore, increases, and disadvantageously the cord load increases for operation. Specifically, a small-sized screen can be wound by a reduced torque, and therefore, the self-contained energizing means and clutch spring need not generate strong resilient force. On the contrary, a large-sized screen requires an increased torque for winding up, and accordingly, an increased resilient force must be produced by the self-contained energizing means and clutch spring. It is, therefore, necessary to select and use clutch springs of different strengths to meet energizing means of different resilient strengths, and apparently, this is inconvenient to a production process, accordingly lowering the productivity. Apparently the mismatching of the clutch spring with the energizing means can be a cause for trouble. The number of the kinds of clutch springs increases with the increase of the kinds of energizing means, and the increased number of parts does not favor the manufacturing cost. In an attempt to reduce the numerous kinds of parts in number, it is proposed that clutch springs whose resilient force meets the strongest resilient force of energizing means appropriate for winding up a largest screen are used in common with all screens of different sizes. This approach, however, has a disadvantage of requiring a same, strong force for operating relatively small-sized roll screen apparatuses.

SUMMARY OF THE INVENTION

One object of the present invention is to provide a roll screen apparatus which is free of such problems as described herein above.

The above described problems are solved by using a stopper (an engagement member) capable of preventing rotation of the screen-winding pipe, and by using a decoupling or disengagement device capable of moving the stopper toward disengagement position in which the screen-winding pipe is put in free rotation.

Specifically, the present invention provides improvements on a roll screen apparatus including a screen-winding pipe whose opposite ends are rotatably supported by the opposite side plates of a frame, the screen-winding pipe having one lateral side of a screen for winding and unwinding, and being equipped with a winding spring for applying a force to the screen-winding pipe at all times to rotate it in the direction in which the screen is wound up thereon, and a clutch device to permit transmission of the rotating force of an associated pulley or use of the resilient force of the winding spring, and the improvements reside in the clutch device. According to one aspect of the improvements, the clutch device comprises:

a stationary axle having a through hole, and being fixed to one side plate;

a clutch casing connected to the pulley so as to rotate together as a whole, the pulley being rotatably fixed to the stationary axle;

a clutch mechanism provided between the pulley and the clutch casing, responsive to application of the rotating force from the pulley for coupling the pulley with the clutch casing, thereby permitting the pulley and the clutch casing to rotate together as a whole, and responsive to application of the rotating force from the clutch casing for preventing the clutch casing and the pulley from rotating about the stationary axle;

a stopper rotatably fixed to the stationary axle, relative rotation between the stopper and the clutch casing being prevented, but axial displacement of the stopper is permitted;

a plug connected to the screen-winding pipe for rotating together as a whole;

a coiled spring to push the stopper at all times toward coupling position in which the stopper and the plug are connected together to rotate as a whole: and decoupling means extending in the through hole of the stationary axle, and being responsive to external operation for moving in such a direction that the stopper is disconnected from the plug.

The decoupling means may include:

a pushing member fitted on the end of the stationary axle so as to permit axial displacement;

a stopper releasing cord one end of which is connected to the end of the pushing member, and the other end of which cord appears from the side plate after passing through the through hole of the stationary axle, and a thumb piece attached to the end of the stopper releasing cord.

Also, the decoupling means may comprise:

a pushing member fitted on the end of the stationary axle so as to permit axial displacement:

a stopper releasing cord one end of which is connected to the end of the pushing member, and the other end of which cord appears from the side plate after passing through the through hole of the stationary axle, and a tension bar rotatably fixed between the stationary axle and the side plate, extending perpendicular to the stationary axle, the tension bar having a projection laterally extending below the pulley, leaving a space enough to accommodate the winding or "up" side of an operation cord, thus causing the tension bar to rotate by pulling down the operation cord thereby to pull out the stopper releasing cord, which is connected to the tension bar.

The end length of the stopper releasing cord may extend along a selected length round the outside of the tension bar to be connected thereto.

The tension bar may have a cam surface formed thereon to cooperate with a slope piece attached to the stopper releasing cord in such a way that the slope piece is guided by the cam surface to pull the stopper releasing cord out of the stationary axle upon angular rotation of the tension bar.

The tension bar may have a female-tapped hole at its pivot center to engage with a male-threaded piece attached to the end of the stopper releasing cord, which male-threaded piece advances forward to pull the stopper releasing cord behind.

The tension bar may have teeth formed on a selected length round the outside of the tension bar to engage corresponding teeth formed on the end of the stopper releasing cord, thereby moving the end of the stopper releasing cord apart from the stationary axle upon angular rotation of the tension bar.

The decoupling means may comprise:

a pushing member capable of pushing the stopper;

a stopper releasing cord capable of moving the pushing member, one end of the stopper releasing cord being connected to the end of the pushing member, and the other end of the stopper releasing cord appearing from the side plate after passing through the through hole of the stationary axle, and a swingable member to cooperate with the pulley so as to sandwich the winding or "up" side of an operation cord between the pulley and the swingable member, the free end of the swingable member being responsive to the pulling-down of the operation cord for swinging apart from the pulley, thereby pulling the stopper releasing cord, which is connected to the free end of the swingable member According to another aspect of the improvements the clutch device comprises:

a stationary axle unrotatably mounted to the side plates;

a plug rotatably supported relative to the stationary axle, and connected to the screen-winding pipe so as to rotate together as a whole;

a rotational cylinder relatively rotatable a predetermined angle to the pully, and connectable so as to rotate together as a whole;

an engagement member for connecting or disconnecting between the rotatational cylinder and the plug depending on the relative rotation of the engagement member to the rotational cylinder;

a unidirectional clutch spring to engage or disengage the rotational cylinder to the stationary axle depending on the rotative direction of the rotational cylinder.

DETAILED DESCRIPTION OF THE INVENTION

The stopper releasing cord is pulled down from the side plate, thereby pulling the pushing member toward the side plate to push the stopper apart from the plug against the coiled spring. Thus, the stopper is disconnected from the plug, putting the plug and the screen-winding pipe in a rotatable condition. The screen-winding pipe, therefore, rotates by the self-contained, winding spring to wind up the screen thereon. When it is desired that the screen stops after it has been completely wound up on the screen-winding pipe or on the way to the compete winding-up, the hold on the stopper releasing cord is lost, thereby removing the pushing force from the pushing member to allow the stopper to be pushed against the plug under the influence of the coiled spring. Thus, the stopper is connected to the plug, thereby preventing the screen-winding pipe from rotating, and transmission of rotation of the pulley to the screen-winding pipe is permitted.

As for a roll screen apparatus using a tension bar having a lateral projection to loosely sandwich the winding or "up" side of the operation cord between the lateral projection and the pulley for swinging the tension bar in response to the pulling-down of the operation cord, it works as follows.

Particularly as for a tension bar having a selected end length of the stopper releasing cord extending along a corresponding length round the outside of the tension bar before reaching the fixing point, angular rotation of the tension bar increases the selected end length of the stopper releasing cord round the outside of the tension bar, and accordingly, the stopper releasing cord is pulled out of the stationary axle until the screen-winding pipe is put in condition for free rotation. Thus, the screen is wound up on the screen-winding pipe.

Particularly as for a tension bar having a cam surface formed thereon to cooperate with a slope piece attached to the stopper releasing cord, angular rotation of the tension bar causes the cam surface to guide and move the slope piece, pulling the stopper releasing cord out of the end of the stationary axle until the screen-winding pipe is put in condition for free rotation. Thus, the screen is wound up on the screen-winding pipe.

Particularly as for a tension bar having a female-tapped hole at its pivot center to engage with a male-threaded piece attached to the end of the stopper releasing cord, rotation of the tension bar causes the male-threaded piece to advance forward, pulling the stopper releasing cord behind until the screen-winding pipe is put in condition for free rotation. Thus, the screen is wound up on the screen-winding pipe.

Particularly as for a tension bar having teeth formed on a selected length round the outside of the tension bar to engage corresponding teeth formed on the end of the stopper releasing cord, rotation of the tension bar causes the end of the stopper releasing cord to move apart from the stationary axle, pulling the stopper releasing cord behind until the screen-winding pipe is put in condition for free rotation. Thus, the screen is wound up on the screen-winding pipe.

Finally, as for a swingable member to cooperate with the pulley so as to sandwich the winding or "up" side of the operation cord between the pulley and the swingable member, the pulling-down of the operation cord causes the free end of the swingable member to swing apart from the pulley, thereby pulling the stopper releasing cord until the screen-winding pipe is put in condition for free rotation. Thus, the screen is wound up on the screen-winding pipe.

As regards the stopping operation of a roll screen apparatus using a tension bar or swingable member described above: specifically when it is desired that the screen stops after the complete winding-up of the screen on the screen-winding pipe or on the way to the end of winding-up, the hold on the operation cord is lost, thereby removing the pulling force from the operation cord, and therefore, removing the pushing force from the pushing member to allow the stopper to be pushed against the plug by the coiled spring, thus permitting the stopper to couple with the plug. As a result, rotation of the screen-winding pipe is prevented, and transmission of the pulley is permitted. At the same time the tension bar or swingable member returns to the original position.

As may be apparent from the above, the pulley can be operatively connected to the screen-winding pipe by allowing the stopper to be pushed against the plug by the coiled spring, and the pulley can be disconnected from the screen-winding pipe by pulling the stopper releasing cord out of the end of the stationary cord, thereby pulling the stopper apart from the plug against the coiled spring. This permits use of coiled springs of same resilient strength irrespective of self-contained winding springs whose resilient strength depends on the size of the screen to be wound up. Use of coiled springs of the same resilient strength is advantageous to assembling work, which is guaranteed free of assembling wrong parts to clutch devices, which will be rejected as being defective. Also advantageously, the number of parts is reduced. Large-sized roll screen apparatuses can be operated with same operating force as required in small-sized roll screen apparatuses thanks to use of same coiled springs.

BRIEF DESCRIPTION OF THE DRAWINGS

FIG. 23 is a sectional view of the left end of the roll screen apparatus of FIG. 14;

FIG. 24 is a sectional view taken along the line 3—3 in FIG. 23;

FIG. 25 is a sectional view taken along the line 4—4 in FIG. 23;

FIG. 26 is similar to FIG. 24, but showing the position in which the screen is rolled; and FIG. 27 is similar to FIG. 25, but showing the position in which the screen is rolled.

DETAILED DESCRIPTION OF THE PREFERRED EMBODIMENTS

Preferred embodiments of the roll screen apparatus according to the present invention will be described with reference to the accompanying drawings.

FIRST EMBODIMENT

Figure 1:
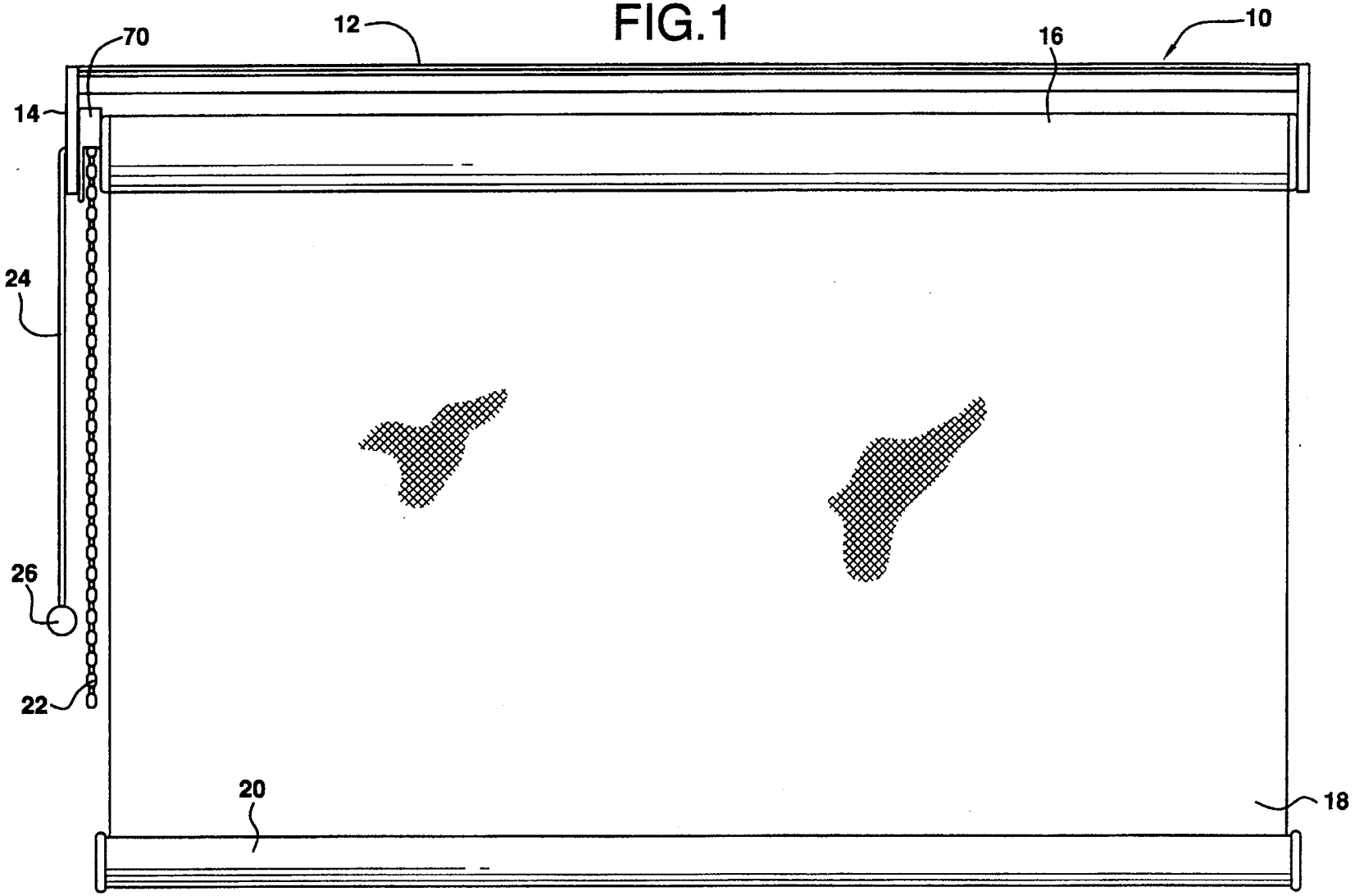
FIG. 1 is a whole view of a roll screen apparatus according to a first embodiment of the present invention.

FIG. 1 shows a roll screen apparatus 10 according to the present invention. A frame 12 is used to fix the roll screen apparatus 10 to a window frame, and it has side plates 14 at its opposite ends. A screen-winding pipe 16 is rotatably supported by the opposite side plates 14. One lateral side of a screen 18 is fixed to the screen-winding pipe 16 by an elongated plate 19 (See FIG. 5), and the screen-winding pipe 16 is spring-biased to wind up the screen thereon by a winding spring (not shown). The other lateral side of the screen 18 has a weight rod 20 to stretch the screen 18 by gravity. A wheel cover 70 is fixed to the left end of the screen-winding pipe 16, and an operation chain (operation cord) 22 appears from the wheel cover 46 for rotating chain (operation cord) 22 appears from the wheel cover 46 for rotating the screen-winding pipe 16. The operation chain 22 is an endless ball-connected chain. Also, another cord 24 appears from the side plate 14 for releasing a stopper (engagement member) as later described. The stopper releasing cord 24 has a small round lump 26 fixed at its end.

Figure 2:
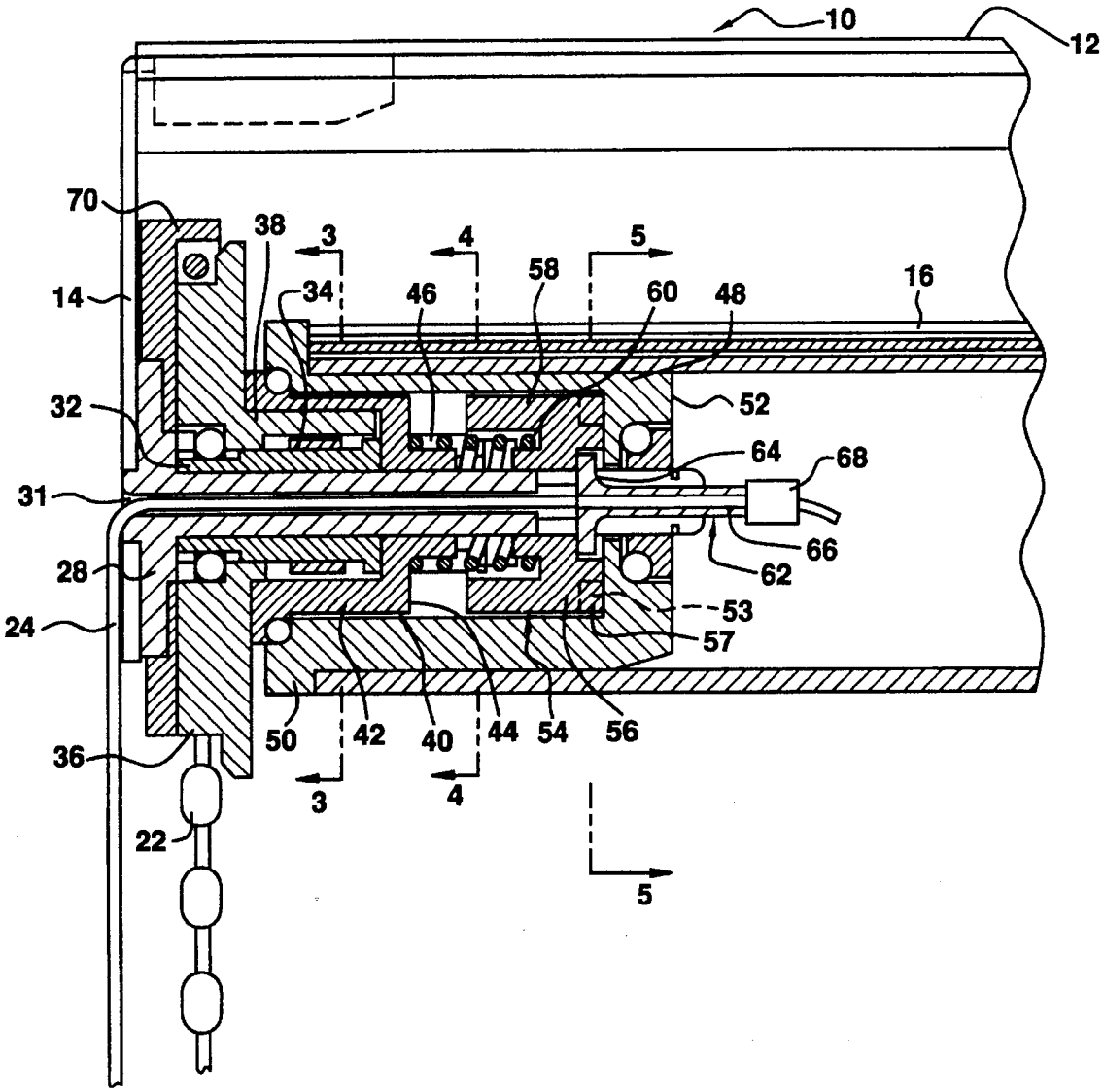
FIG. 2 is a longitudinal section of the left end of the roll screen apparatus of FIG. 1.
Figure 5:
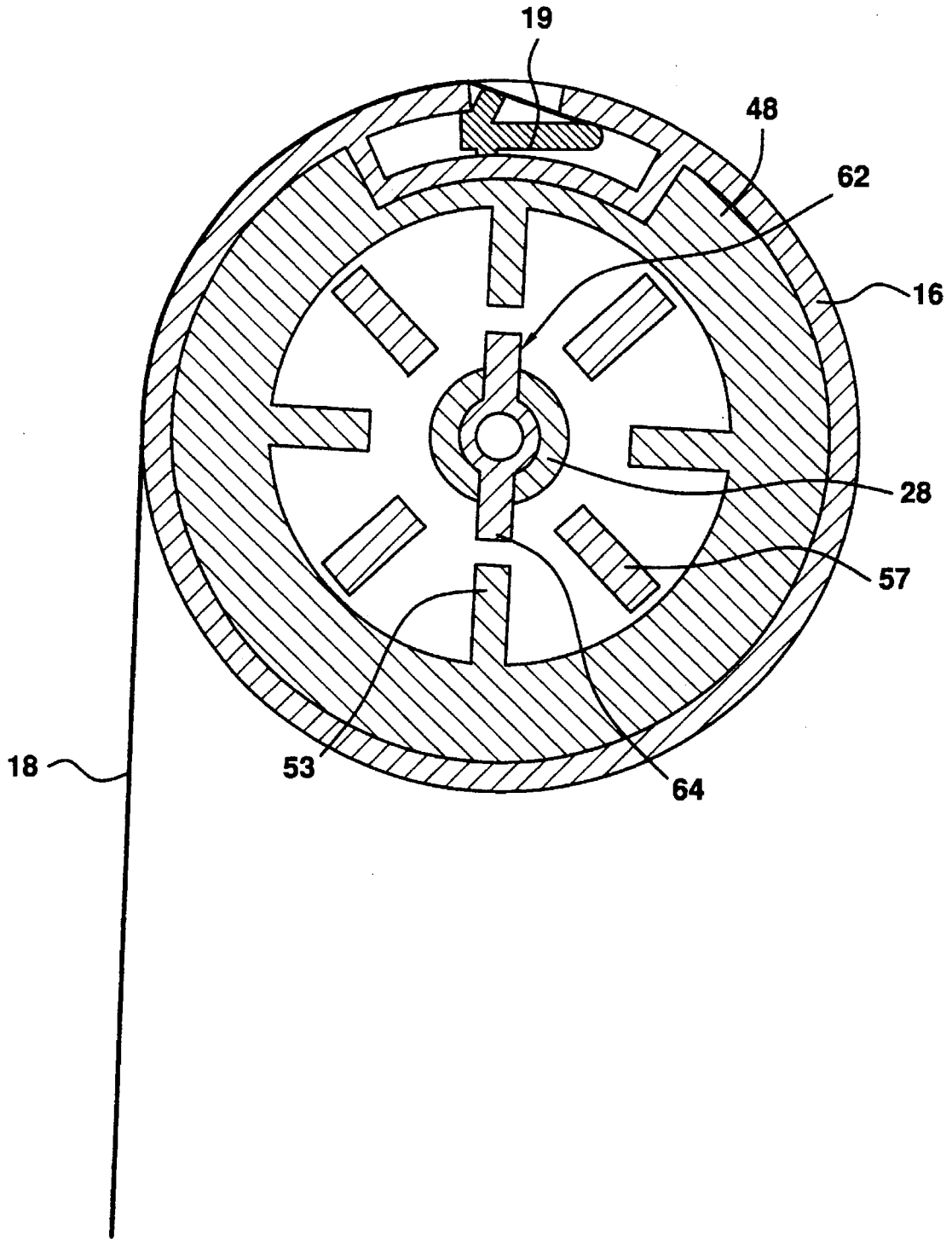
FIG. 5 is a cross section taken along the line 5—5 in FIG. 2.
Figure 6:
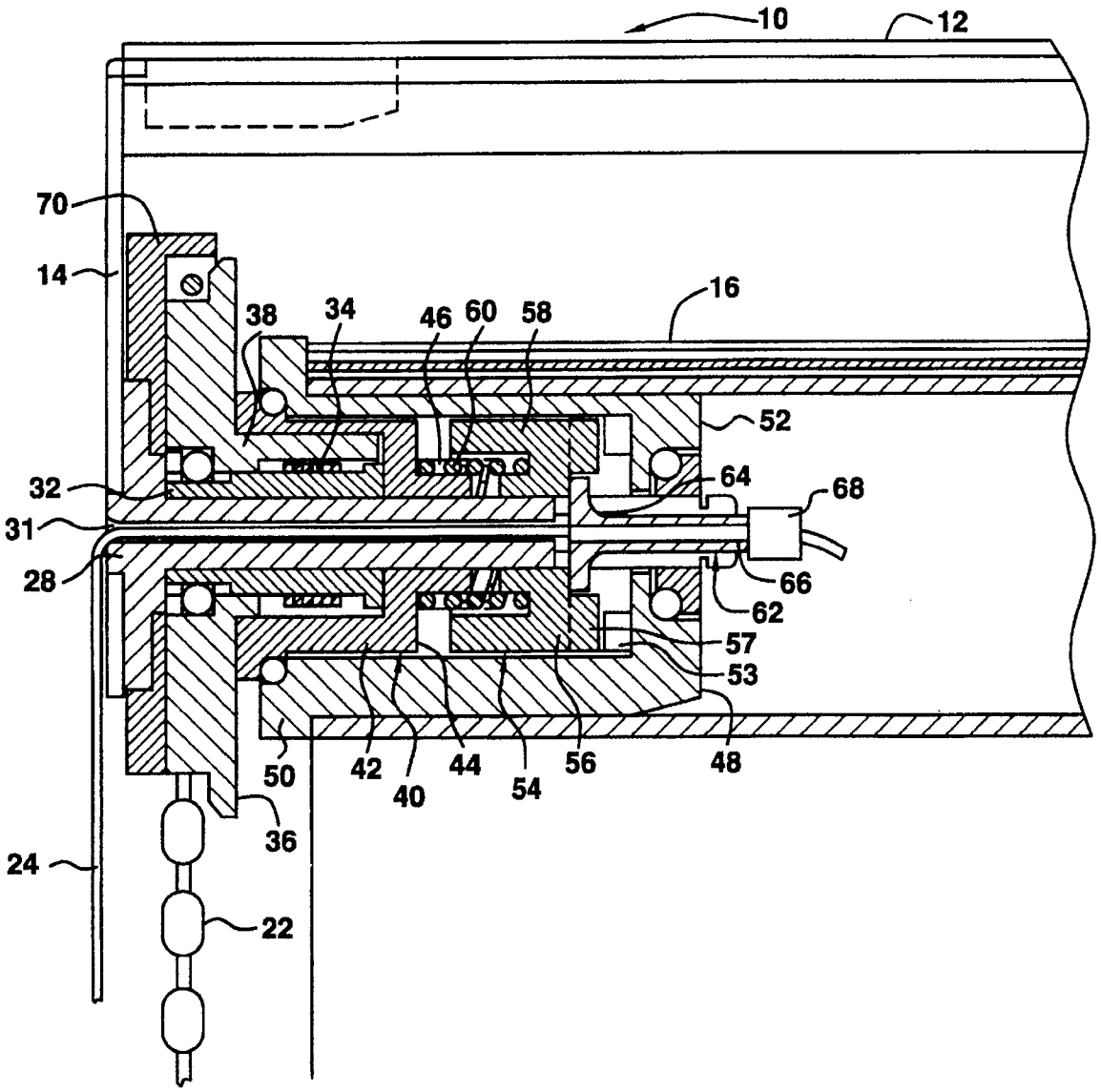
FIG. 6 is similar to FIG. 2, but showing that the stopper is released.

FIG. 2 shows, in section, the left end of the roll screen apparatus 10 of FIG. 1. A stationary axle 28 is fixed to the left side plate 14, extending rightward to the inside of the screen-winding pipe 16 in coaxial relation. The stationary axle 28 is partly hexagonal and partly circular in cross section, and it has a through hole 31 at its center. A clutch drum 32 is fixed to the hexagonal part of the stationary axle, thus not permitted to rotate about the stationary axle 28. The rear part of the clutch drum 32 extends in the screen-winding pipe 16, and has a clutch spring 34 wound therearound. On the side of the side plate 14 the front part of the clutch drum 32 appears from the screen-winding pipe 16, and has a pulley 36 rotatably fixed thereto. The operation chain 22 runs around the pulley 36 for the purpose of rotating the pulley 36. The pulley 36 has a drive piece 38 integrally connected thereto. It has a circumferentially arcuate-and-axially linear shape, extending parallel to the clutch drum 32, and the clutch spring 34 is between the clutch drum 32 and the drive piece 38 of the pulley 36, as seen from FIG. 3. A cylindrical clutch casing 40 is rotatably fitted on the drive piece 38 of the pulley 36 with its cylindrical wall 42 encircling the arcuate drive piece 38. The cylindrical wall 42 has two radial projections 41 and 43 at predetermined distance from each end of the clutch spring 34, thereby preventing the clutch spring 34 from rotating with respect to the clutch casing (rotational cylinder) 40, as seen from FIG. 3. The round part of the stationary axle 28 is inserted in the through hole of the bottom 44 of the clutch casing 40, thereby permitting rotation of the clutch casing 40 about the stationary axle. The clutch casing 40 has two transmission pieces 46 integrally connected to its bottom 44. Each transmission piece 46 has a circumferentially arcuate-and-axially linear shape, extending parallel to the stationary axle 28, each separating a predetermined circumferential distance from the other. A cylindrical plug 48 is rotatably fitted on the cylindrical wall 42 of the clutch casing 40. The plug 48 has a collar 50 integrally connected to its opening end, and the plug 48 is press-fitted in the screen-winding pipe 16 with its collar 50 abutting on the end of the screen-winding pipe 16, thereby permitting the plug 48 to rotate along with the screen-winding pipe 16 as a whole. The plug 48 has four 90 degree-apart ribs 53 integrally connected to and projecting inward from its bottom 52. A stopper 54 is rotatably fixed to the stationary axle 28, and is located between the clutch casing 40 and the bottom 52 of the plug 48. The stopper 54 comprises a disk 56 having, on one side, two arcuate projections 58 separating circumferentially by predetermined distances and extending axially toward the clutch casing 40, and, on the other side, four 90 degree-apart ribs 57 extending axially toward the plug 48, which ribs 57 can be put in contact with corresponding 90 degree-apart ribs 53 of the plug 48. Relative rotation between the two arcuate projections 58 of the stopper 54 and the two transmission pieces 46 of the clutch casing 40 is prevented, but axial displacement of the arcuate projections 58 of the stopper 54 toward the transmission pieces 46 of the clutch casing 40 is permitted. A coiled spring 60 is put between the clutch casing 40 and the stopper 54 to push the stopper 54 against the plug 48 at all times. When the stopper 54 is pushed against the plug 48, the ribs 57 of the stopper 54 are put in condition for contact with the ribs 53 of the plug 48. A "T"-shaped pin 62 (pusher) is slidably fitted on the rear part of the stationary axle 28. The "T"-shaped part of the pusher 62 is located in the plug 48, and its transverse size is larger than the diameter of the stationary axle 28, as shown in FIG. 5. Therefore, the "T"-shaped part of the pin 62 can press against the disk 56 of the stopper 54. The pin 62 has a through hole 66. The stopper-releasing cord 24 passes through the through hole 31 of the stationary axle 28 and the through hole 66 of the pin 62, and a string catch piece 68 having a diameter larger than the pin 62 is attached to the end of the stopper-releasing cord 24 to prevent the slipping-off of the cord 24 from the pin 62 and the stationary axle 28. A wheel cover 70 is fixed to the enlarged end of the stationary axle 28, and is positioned between the side plate 14 and the pulley 36. The wheel cover 70 prevents the operation chain 22 from falling off from the pulley 36.

As may be understood from the above, a clutch mechanism is made up by the clutch spring 34 and the clutch drum 32; a disconnection mechanism is made up by the stopper releasing cord 24, the through hole 31 of the stationary axle 28, the pin 62, the through hole 66 of the pin 62 and the string catch piece 68; and a clutch device is made up by the clutch mechanism, the stopper releasing cord 24, the pulley 36, the clutch casing 44, the plug 48, the stopper 54 and the coiled spring 60.

Now, the manner in which the roll screen apparatus works is described. When it is desired that the screen 18 is unwound from the screen-winding pipe 16, on which the screen 18 wound up, the unwinding or "down" side of the operation chain 22 is pulled down to rotate the pulley 36, thus causing the rotating drive piece 38 to circumferentially press against one end of the clutch spring 34. As a result, the clutch spring 34 radially expands until the clutch spring 34 can rotate about the clutch drum 32, but relative rotation between the drive piece 38 and the clutch casing 40 is prevented. Rotation of the clutch casing 40 is transmitted to the stopper 54 because the transmission pieces 46 of the clutch casing 40 rotate along with the arcuate projections 58 of the stopper 54. As described earlier, the stopper 54 is pushed against the bottom 52 of the plug 48 by the coiled spring 60, and therefore, the plug 48 rotates along with the rotating stopper 54 with the ribs 53 of the plug 48 engaged with the ribs 57 of the stopper 54, thus causing the screen-winding pipe 16 to rotate along with the plug 48. Accordingly, the screen 18 is unwound from the screen-winding pipe 16 to increase its depending length.

When it is desired that the screen 18 stops in the course of unwinding, the operation chain 22 is not operated to give the pulley 36 a rest. Then, the screen-winding pipe 16, which is spring-biased toward the winding of the screen, is "eager" to rotate in the direction in which the screen 18 is wound up, just opposite to the direction in which the screen-winding pipe 16 was being rotated to wind up the screen 18. The screen-winding, rotating force is transmitted from the screen-winding pipe 16 to the clutch casing 40 to cause it to contact and press against the clutch spring 34 until the coiled spring 34 tightens about the clutch drum 32, thereby preventing rotation of the clutch casing 40, and hence the screen-winding pipe 16. Thus, the screen 18 stops.

When it is desired that the screen 18 is wound up, the stopper releasing cord 24 is pulled down to move the pin 62 to the left, driving the disk 56 of the stopper 54 against the counter resilient force of the coiled spring 60 to the position in which the ribs 57 of the stopper 54 axially leave the ribs 53 of the plug 48. Disconnection of the stopper 54 from the plug 48 permits the screen-winding pipe 16 to rotate along with the plug 48 under the influence of the winding spring, thus winding up the screen 18 to decrease its depending length.

When the screen 18 has been completely wound up on the screen-winding pipe 16, or when it is desired that the rising of the screen 18 stops in the course of winding-up, the hold on the stopper-releasing cord 24 is lost, thereby removing the pulling force from the pin 62 to allow the pin 62 to be pushed against the bottom 52 of the plug 48 by the coiled spring 60. Thus, the ribs 57 of the stopper 54 contact again the ribs 53 of the plug 48, and therefore, rotation of the screen-winding pipe 16 is prevented, and transmission of rotation of the pulley 36 is permitted.

SECOND EMBODIMENT

Figure 7:
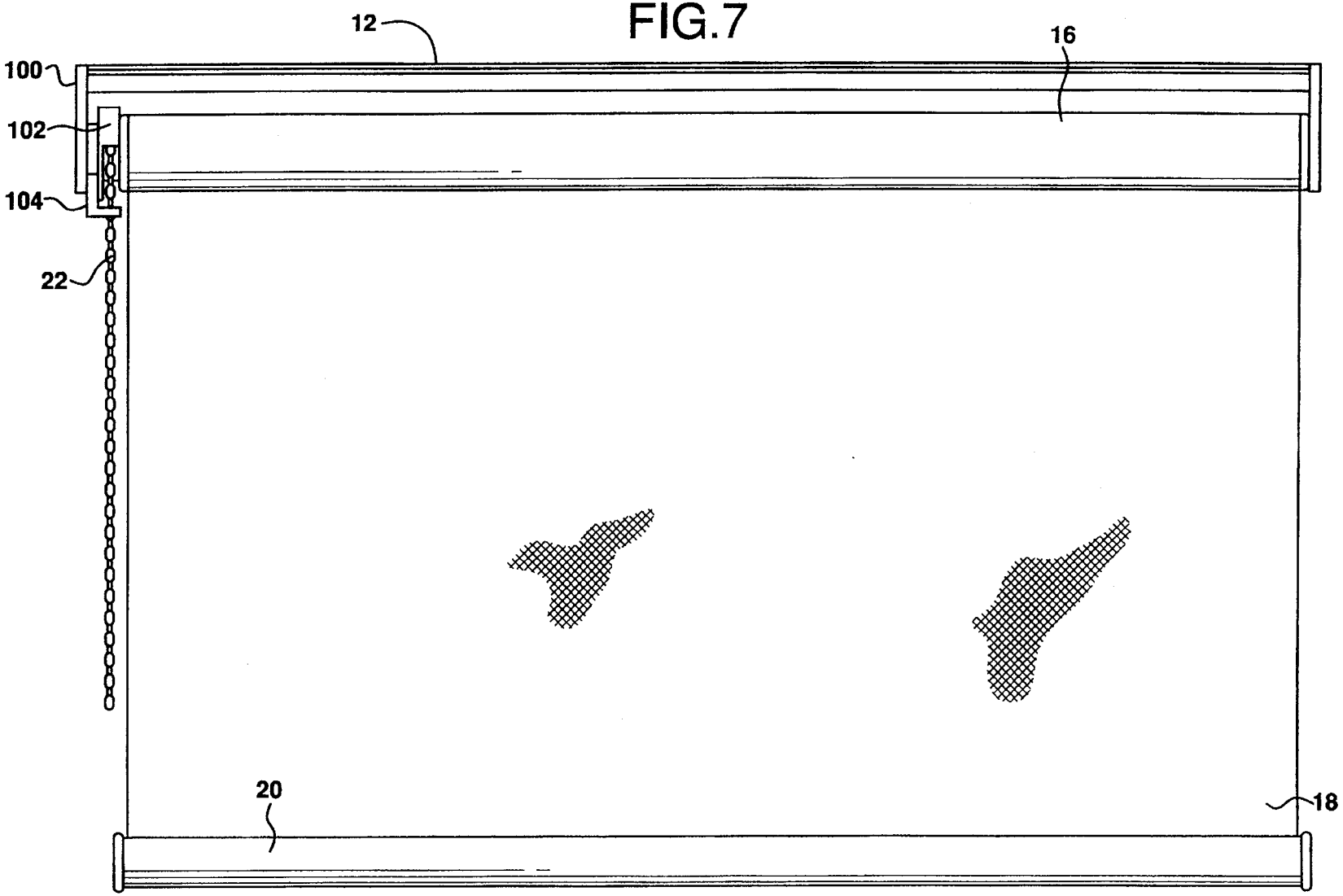
FIG. 7 is a whole view of a roll screen apparatus according to a second embodiment of the present invention.

FIG. 7 shows a roll screen apparatus according to the second embodiment of the present invention. It is different from the roll screen apparatus of the first embodiment in that: the stopper releasing cord does not appear from the side plate; a tension lever 104 is used; and the side plate and the wheel cover are modified in shape so as to permit the fixing of the tension lever 104 in the so modified wheel cover 102.

Figure 8:
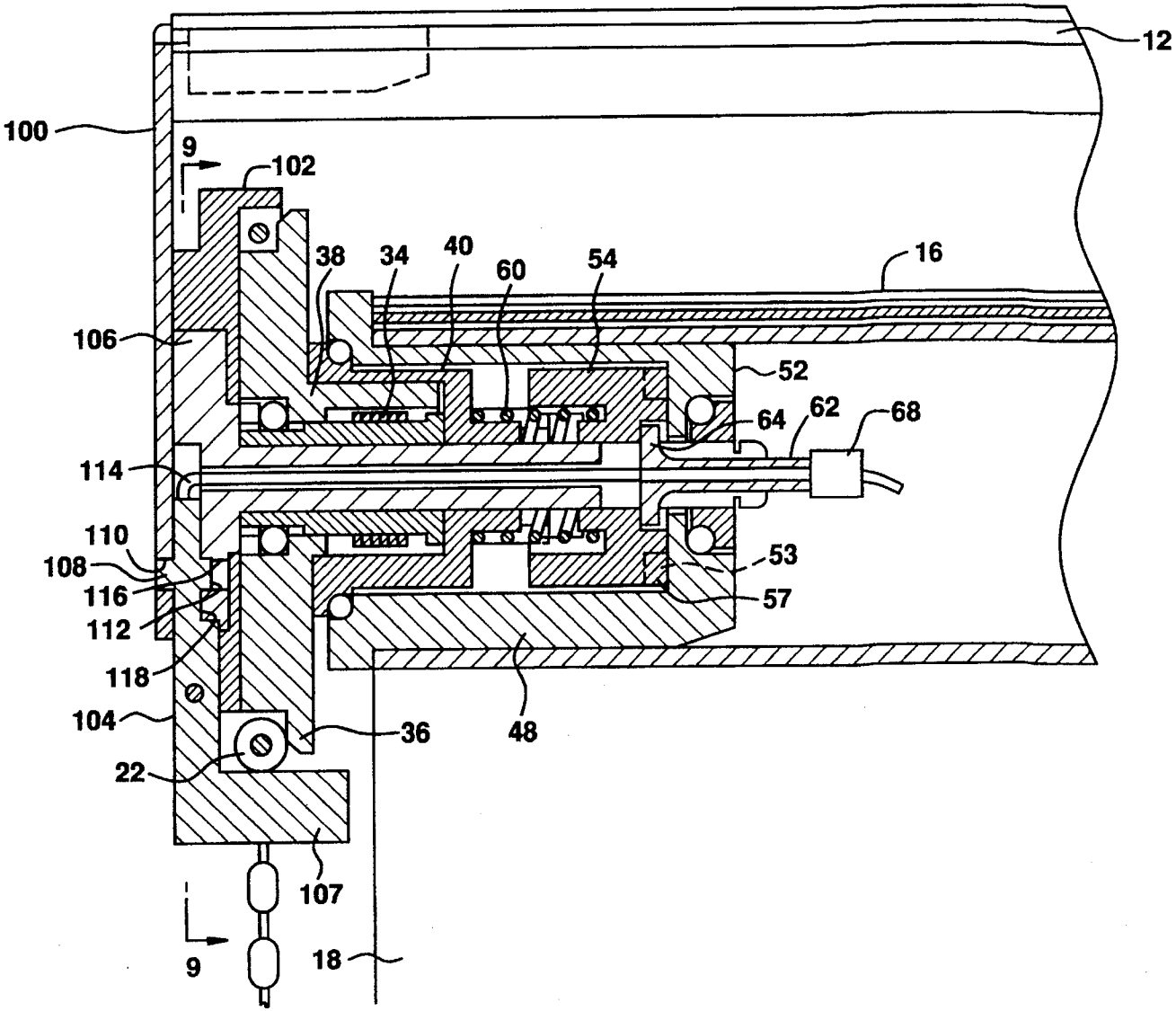
FIG. 8 is a longitudinal section of the left end of the roll screen apparatus of FIG. 7.
Figure 9:
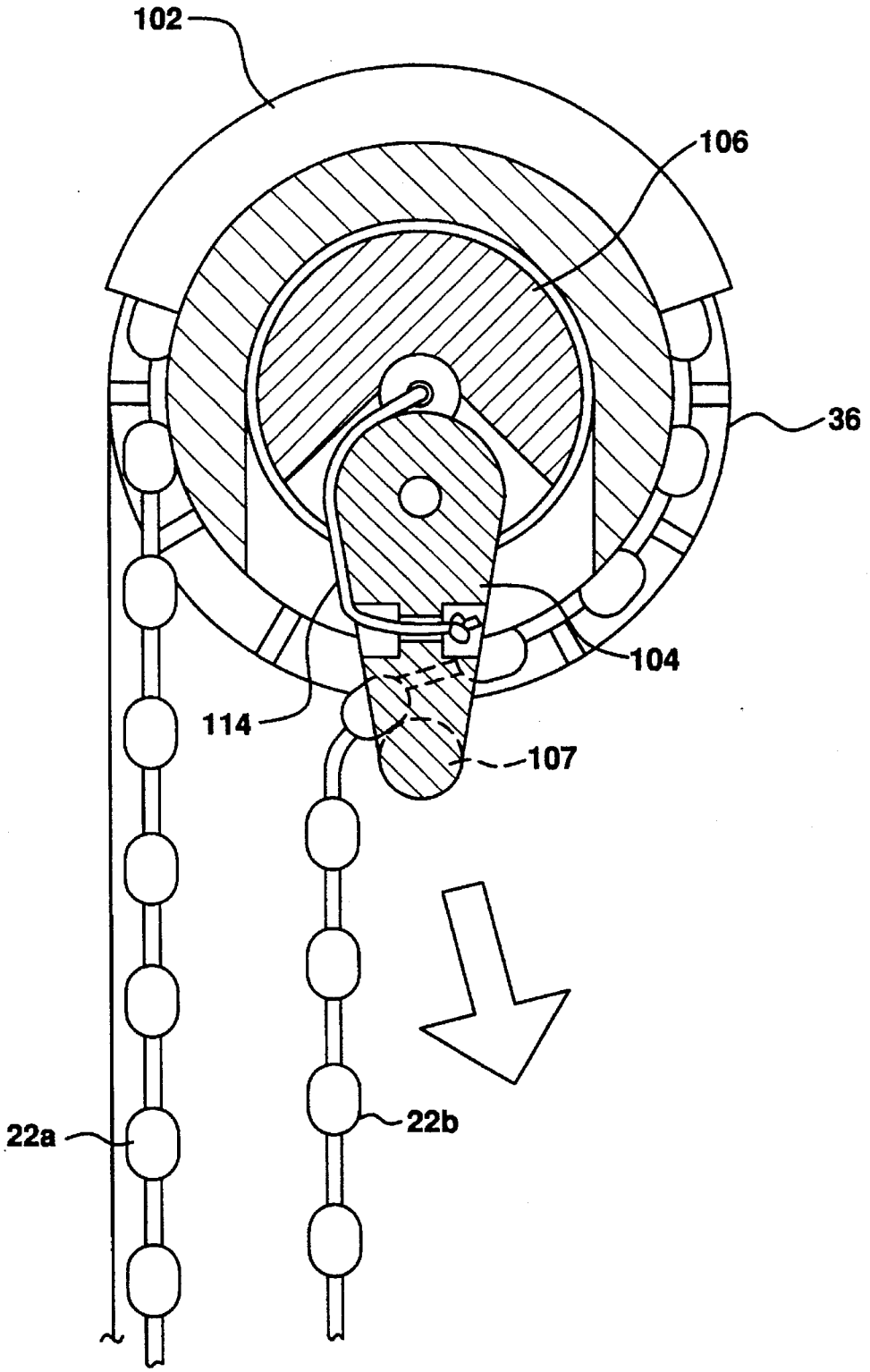
FIG. 9 is a cross section taken along the line 9—9 in FIG. 8.

FIG. 8 shows, in section, the left end of the roll screen apparatus of FIG. 7. All the parts other than the wheel cover 102, the tension bar 104 and the stationary axle 106 are same as those of the first embodiment. The tension bar 104 has an "L"-shape in section, and is sandwiched between the wheel cover 102 and the side plate 100 with its lateral projection 107 extending below the pulley 36, leaving a space large enough to permit the operation chain 22 to pass therebetween. The tension bar 104 has cylindrical projections 108 and 112 on its opposite sides, and the tension bar 104 is rotatably fixed to the side plate 100 and the wheel cover 102 by inserting these cylindrical projections 108 and 112 in the hole 110 of the side plate 100 and a groove 116, which is formed along the lower part of the stationary axle 106. Another groove 118 is formed on the tension bar 104 just below the cylindrical projection 112 for the purpose of guidance. The stopper releasing cord 114 appears from the stationary axle 106 to extend round a selected length of the contour of the tension bar 104 as seen from FIG. 9. The length of the stopper releasing cord 114 is so adjusted that the pin 62 is put in the far-distant, right position (FIG. 8) when the tension bar 104 takes a vertical position (FIG. 9). When the tension bar 104 swings, the stopper releasing cord 114 is pulled out of the end of the stationary axle 106.

As may be understood from the above, a decoupling device is made up by the tension bar 104, the stopper releasing cord 114, the through hole of the stationary axle 106, the pin 62, the through hole 66 of the pin and the retaining piece 68.

Now the manner in which the roll screen apparatus according to the second embodiment works is described. When it is desired that the screen 18 is unwound from the screen-winding pipe 16, on which the screen 18 is completely wound up, the unwinding or "down" side **22*a* of the operation chain 22 is pulled down (FIG. 9). Then, the tension bar 104 remains in the vertical position; it cannot swing unless the winding or "up" side 22*b* of the operation chain 22 is pulled down. The pin 62 remains in the far-distant, right position (FIG. 8), in which the stopper 54 is pushed against the bottom 52 of the plug 48 with the ribs 57 of the stopper 54 abutting on the ribs 53 of the plug 48, thereby permitting rotation of the stopper 54 and the plug 48 as a whole. By pulling the unwinding or "down" side 22***a* of the operation chain 22 the pulley 36 is rotated to cause its drive piece 38 to circumferentially press against one end of the clutch spring 34, thereby radially expanding the coiled spring 34 until it can rotate freely about the clutch drum 32. On the other hand, the pulley 36 is rotated to cause its drive piece 38 to couple with the clutch casing 40, thus preventing the relative rotation therebetween. Rotation of the clutch casing 40 is transmitted to the stopper 54 through the agency of their arcuate transmission and projection pieces 46 and 58, which are now brought to coupling condition. Rotation of the stopper 54 causes the coupling of the ribs 57 of the stopper 54 with the ribs 53 of the plug 48, thus permitting rotation of the stopper 54 and the plug 48, and hence the screen-winding pipe 16 as a whole. Accordingly, the screen 18 is unwound from the screen-winding pipe 16 to increase its depending length.

When it is desired that the descending of the screen 18 stops in the course of unwinding, the operation chain 22 is not operated to give the pulley 36 a rest. Then, the screen-winding pipe 16, which is spring-biased toward the winding-up of the screen at all times, is "eager" to rotate in the direction in which the screen 18 is wound up, just opposite to the direction in which the screen-winding pipe 16 was being rotated to unwind the screen 18. The screen-winding, rotating force is transmitted from the screen-winding pipe 16 to the clutch casing 40 to cause it to contact and press against the clutch spring 34 until the coiled spring 34 tightens about the clutch drum 32, thereby preventing rotation of the clutch casing 40, and hence the screen-winding pipe 16 to stop the screen 18.

Figure 10:
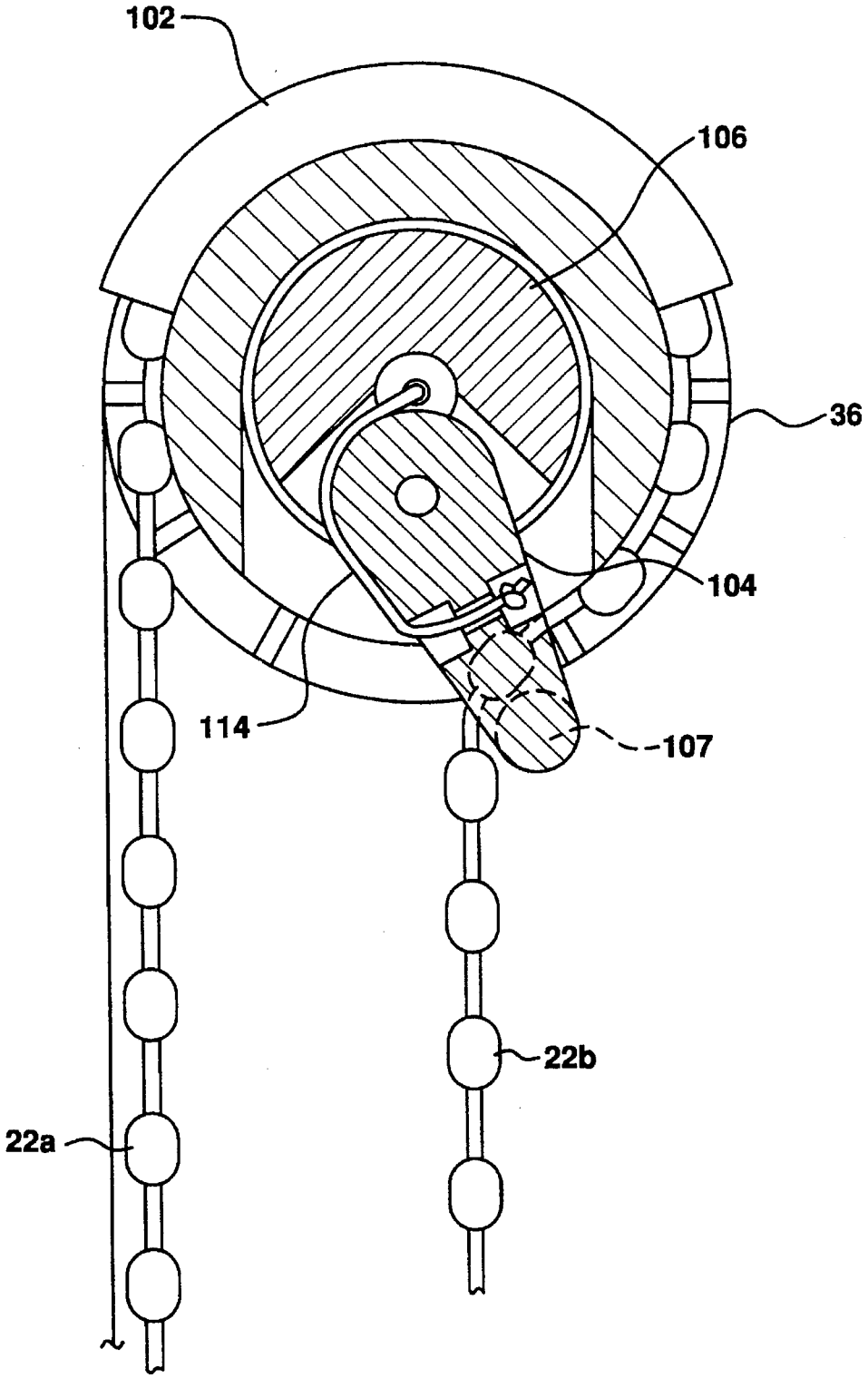
FIG. 10 is similar to FIG. 9, but showing how the tension bar is in releasing the stopper.
Figure 11:
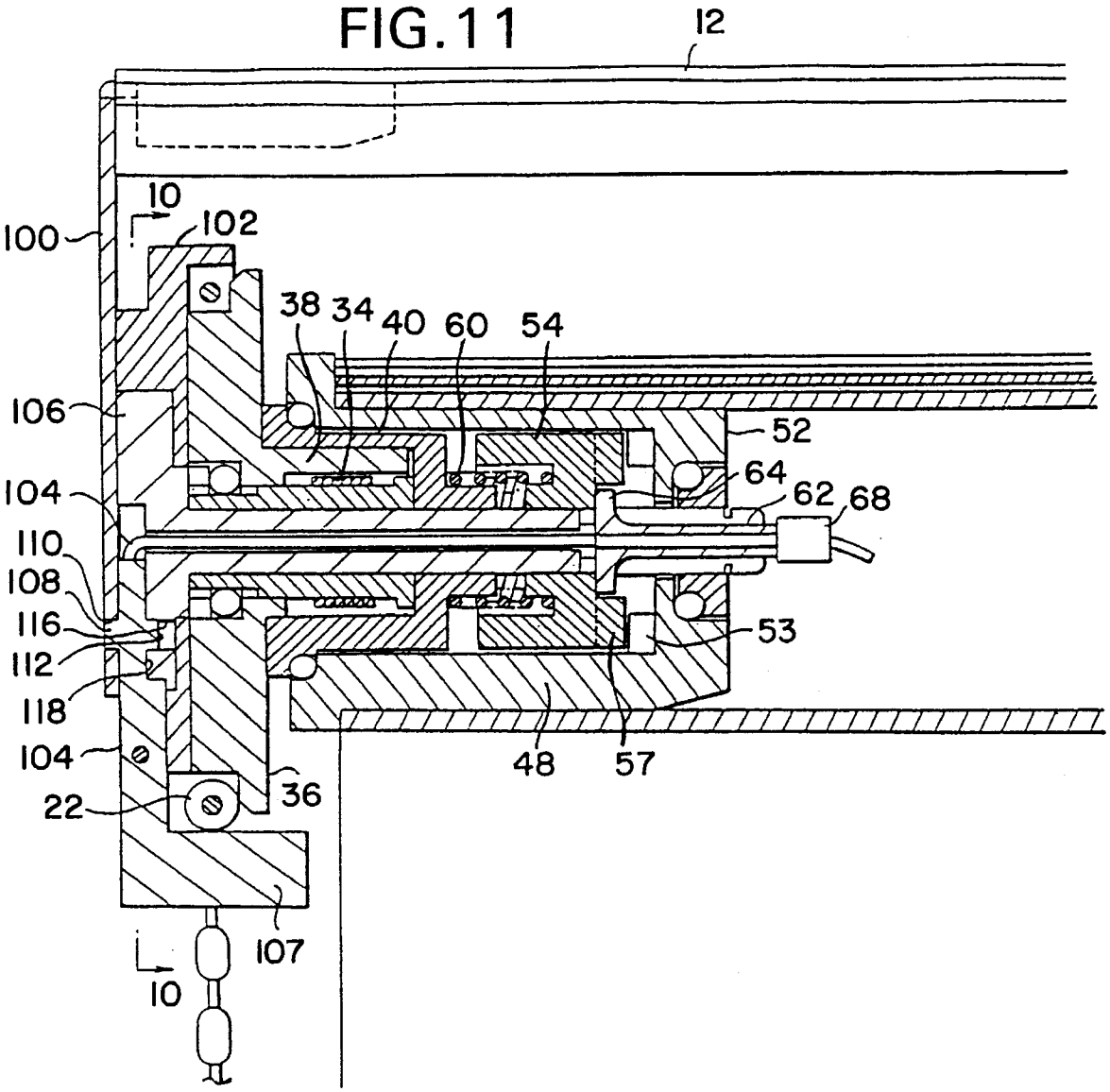
FIG. 11 is similar to FIG. 8, but showing that the stopper is released.

When it is desired that the screen 18 is wound up, the winding or "up" side 22*b* of the operation chain 22 is pulled down (FIG. 9) to swing the tension bar 104 about its cylindrical projections 108 and 112 rightward in FIG. 10, guided with the aid of its groove 118 cooperating with the counter projection from the wheel cover 102. Then, the stopper releasing cord 114 is pulled out of the through hole 31 of the stationary axle 106 by the length corresponding to the angular amount of rotation of the tension bar 104. Accordingly the "T"-shaped head 64 of the pin 62 pushes the disk 56 of the stopper 54 leftward, thus moving the stopper 54 leftward against the counter resilient force of the coiled spring 60. As a result, the ribs 57 of the stopper 54 leave apart from the ribs 53 of the plug 48 until these ribs are disconnected, permitting the screen-winding pipe 16 along with the plug 48 to rotate as a whole under the influence of the winding spring of the screen-winding pipe 16. Thus, the screen 18 is wound up on the screen-winding pipe 16 to decrease its depending length.

When it is desired that the screen 18 stops after the complete winding-up of the screen 18 on the screen-winding pipe 16, or on the way to the complete winding-up of the screen, the hold is lost on the winding or "up" side 22*b* of the operation chain 22, thereby removing the rotating force from the tension bar 104. As a result, the pulling force is removed from the stopper releasing cord 114, thereby releasing the pin 62, and hence permitting the stopper 54 to be pushed against the plug 48 under the influence of the coiled spring 60. Then, the ribs 57 of the stopper 54 are brought to engagement with the ribs 53 of the plug 48, thereby preventing rotation of the screen winding pipe 16 and permitting transmission of rotation of the pulley 36. The tension bar 104 returns to the original vertical position as shown in FIG. 9.

In this particular second embodiment the tension bar 104 is described as having a stopper releasing cord 114 extending round a selected length of the contour of the tension bar and connected directly thereto. Alternatively, a tension bar has a cam surface on its rear side, and an associated slope member moves axially under the control of the cam surface when the tension bar swings, thereby pulling out the stopper releasing cord whose end is connected to the slope member.

Alternatively, a tension bar has a female-tapped hole at its pivot center, and a male-threaded bolt having one end of the stopper releasing cord connected thereto is threadedly engaged with the female-tapped hole of the tension bar. The swinging of the tension bar causes axial displacement of the male-threaded bolt to pull out the stopper releasing cord from the stationary axle.

For another example a tension bar has a toothed part on its upper side, and an associated toothed-member having one end of the stopper releasing cord connected thereto, is engaged with the toothed part of the tension bar. The swinging of the tension bar causes axial displacement of the toothed-member to pull out the stopper releasing cord from the stationary axle.

Figure 12:
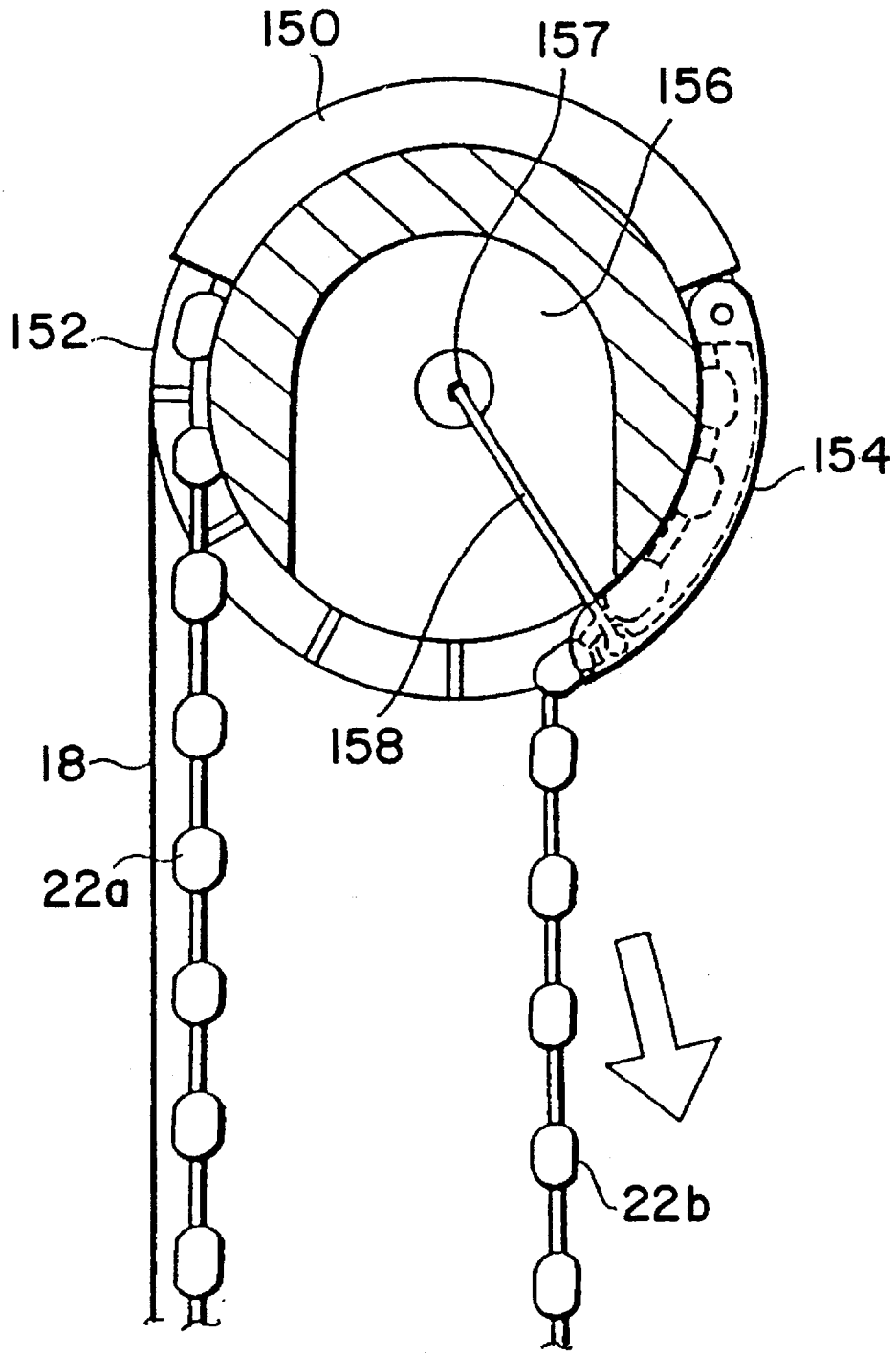
FIG. 12 shows a sixth example of stopper releasing means.

FIG. 12 shows a sixth example, in which an arcuate, swingable extension 154 is rotatably connected to the right end of the wheel cover 150 to confine the winding or "up" side 22*b* of the operation chain 22 in the arcuate space defined between the swingable extension 154 and the corresponding arc of the pulley 36, allowing the winding or "up" side 22*b* of the operation chain 22 to hang from the free end of the swingable extension 154. The stopper releasing cord 158 appears from the through hole 157 of the stationary axle 156, and the end of stopper releasing cord 158 is connected to the free end of the swingable extension 154. The length of the stopper releasing cord 158 is so adjusted that the stopper 54 is closest to the plug 48 when the swingable extension 154 is closest to the pulley 36, and that the stopper 54 is remotest from the plug 48 when the swingable extension 154 is remotest from the pulley 36. The structure and function of the part of the roll screen apparatus other than the pulley 36 and associated structure just described are similar to the first embodiment.

As may be understood from the above, a decoupling device is made up by the swingable extension 154, the stopper releasing cord 158, the through hole 157 of the stationary axle 156, the pin 62, the through hole 66 of the pin, and the small round lump 68.

Next, the operation of a roll screen apparatus using a stopper releasing unit of the sixth example is described. When it is desired that the screen is unwound, or that the screen is made to stop, the operation is similar to that of the second embodiment although the swingable extension 154 does not function in the same way as the tension bar 104. The swingable extension 154 is closest to the pulley 36 (FIG. 12) in the unwinding or stopping operation.

Figure 13:
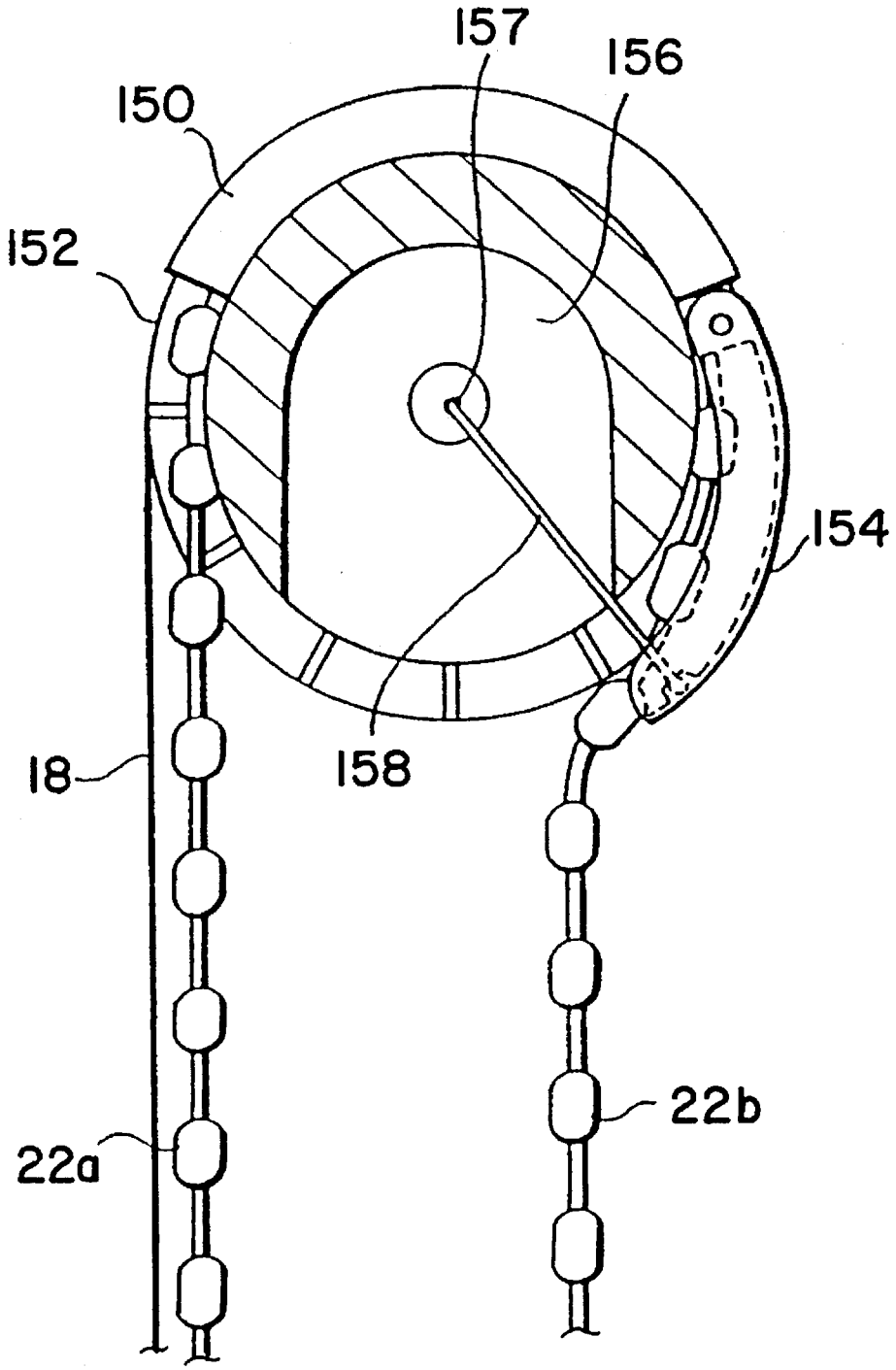
FIG. 13 is similar to FIG. 12, but showing how the swingable extension is in releasing the stopper.

When it is desired that the screen is wound, the part 22*b* of the operation chain 22 is pulled down to swing the swingable extension 154 to the right in FIG. 13, thereby putting the free end of the swingable extension 154 apart from the through hole 157 of the stationary axle 156, and accordingly, pulling the stopper releasing cord 158 apart from the end of the stationary axle 156. Thus, the same operation as the second embodiment is performed.

When it is desired that the screen stops after completing the winding-up of the screen or that rotation of the screen-winding pipe 16 stops on the way to the complete winding-up, the hold is lost on the winding or "up" side of the operation chain 22, thereby removing from the swingable extension 154 the force to swing it to the right in FIG. 13. Thus, the same operation as the second embodiment is performed, and then the swingable extension 154 returns to the pre-swinging position as shown in FIG. 12.

THIRD EMBODIMENT

Figure 14:
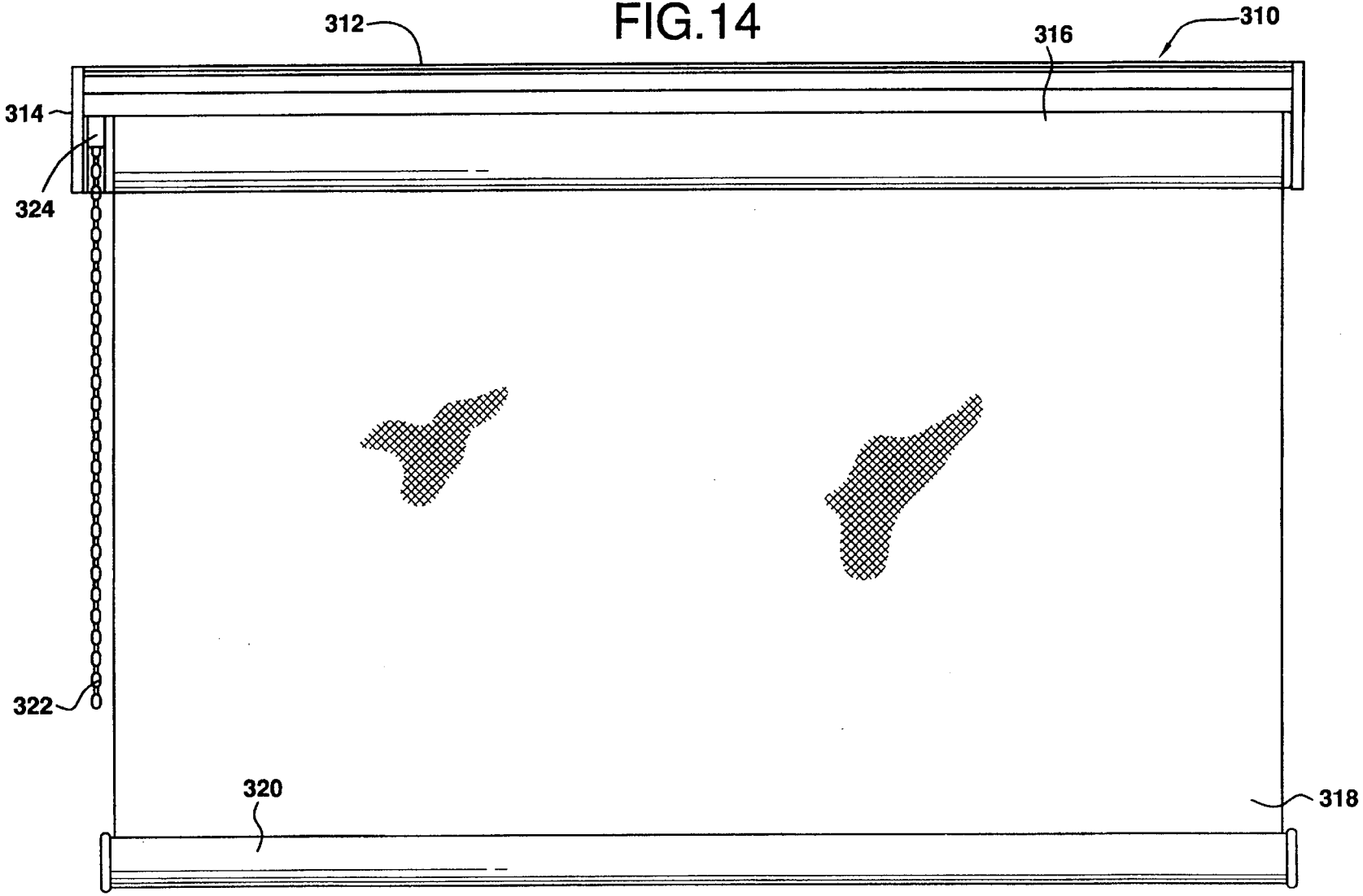
FIG. 14 is a whole view of a roll screen apparatus of the third, forth, and fifth embodiments.
Figure 16:
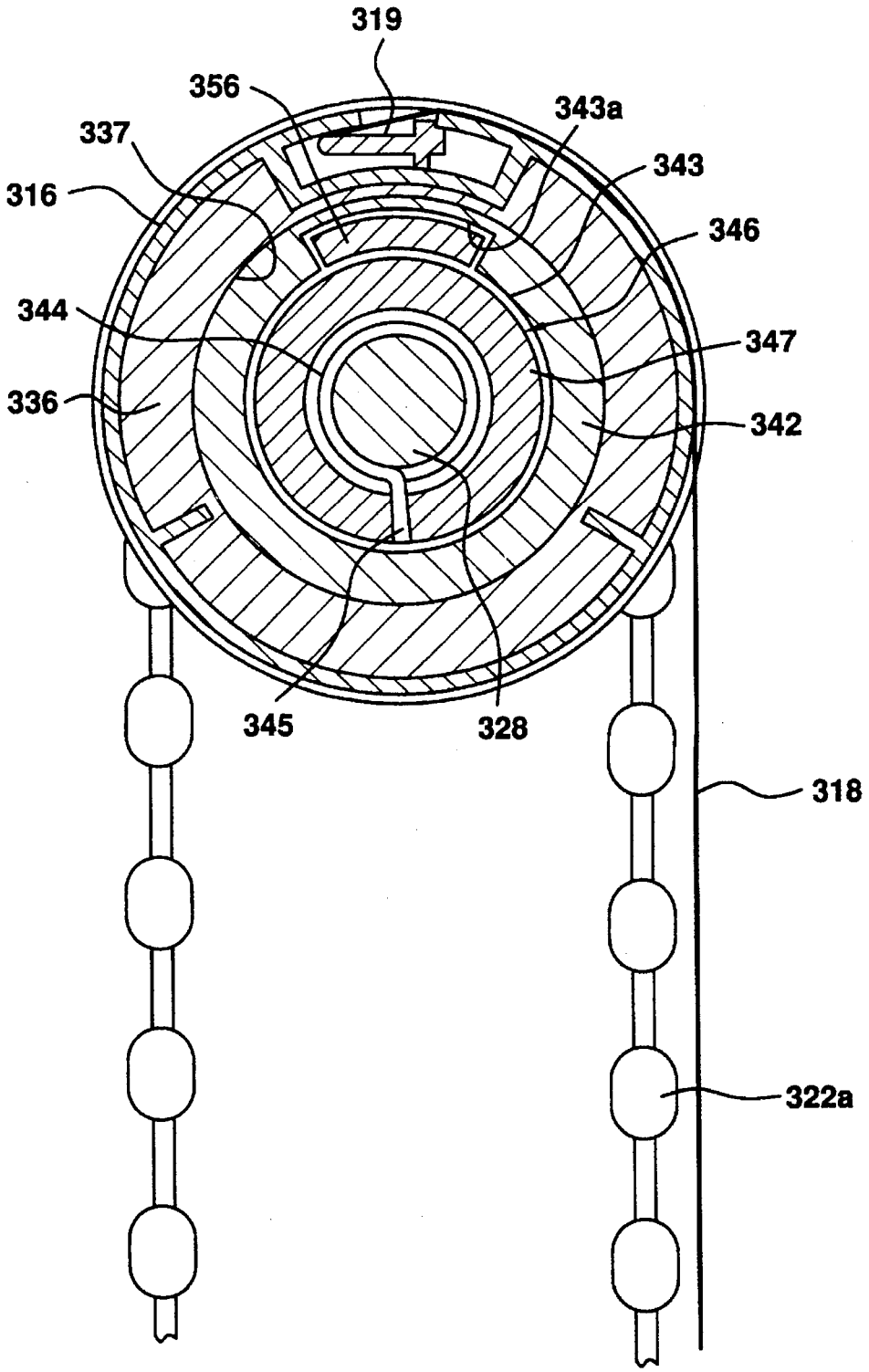
FIG. 16 is a cross section taken along the line 3—3 in FIG. 15.
Figure 17:
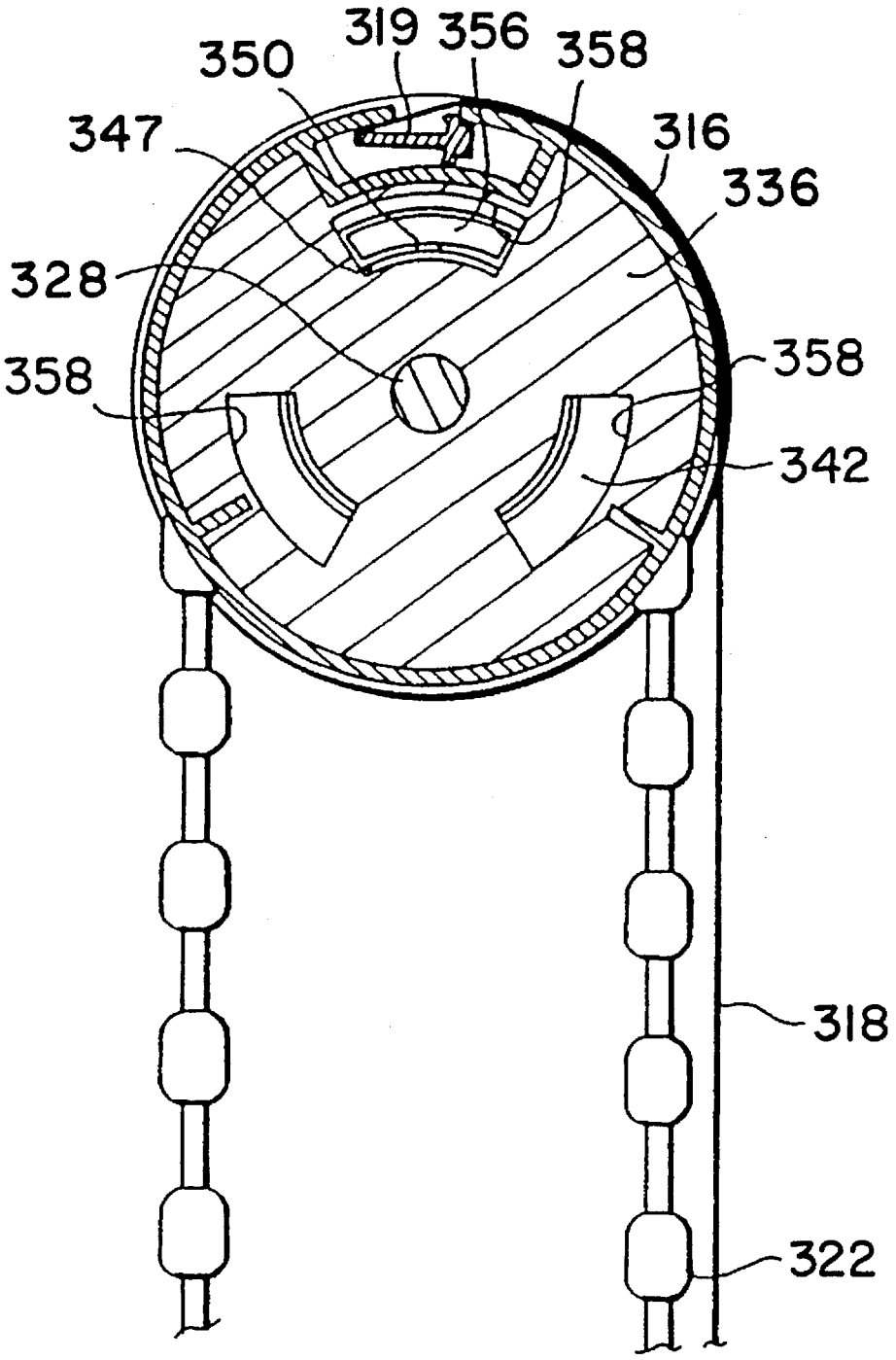
FIG. 17 is a cross section taken along the line 4—4 in FIG. 15.

FIG. 14 shows a roll screen apparatus 310 to which the present invention is applied. A frame 312 is used to fix the roll screen apparatus 310 to a window frame, and it has side plates 314 at its opposite ends. A screen-winding pipe 316 is rotatably supported by the opposite side plates 314. One lateral side of a screen 318 is fixed to the screen-winding pipe 316 by an elongated plate 319 (See FIG. 16), and the screen-winding pipe 316 is spring-biased to wind up the screen thereon by a winding spring (not shown). The other lateral side of the screen 318 has a weight rod 320 to stretch the screen 318 by gravity. A wheel cover 324 is fixed to the left end of the screen-winding pipe 316, and an operation chain (operation cord) 322 appears from the wheel cover 346 for rotating the screen-winding pipe 316. The operation chain 322 is an endless ball-connected chain.

Figure 3:
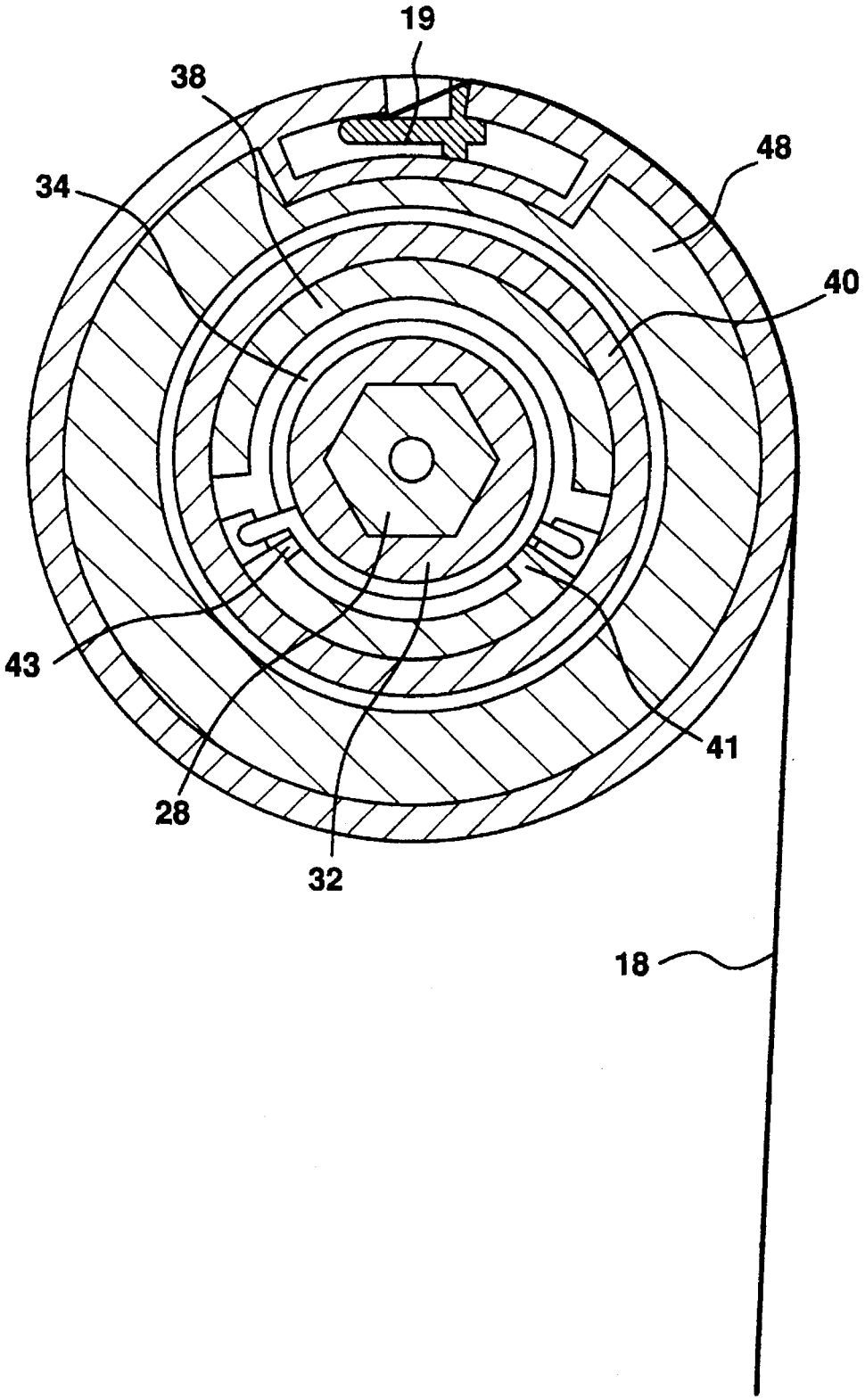
FIG. 3 is a cross section taken along the line 3—3 in FIG. 2.
Figure 4:
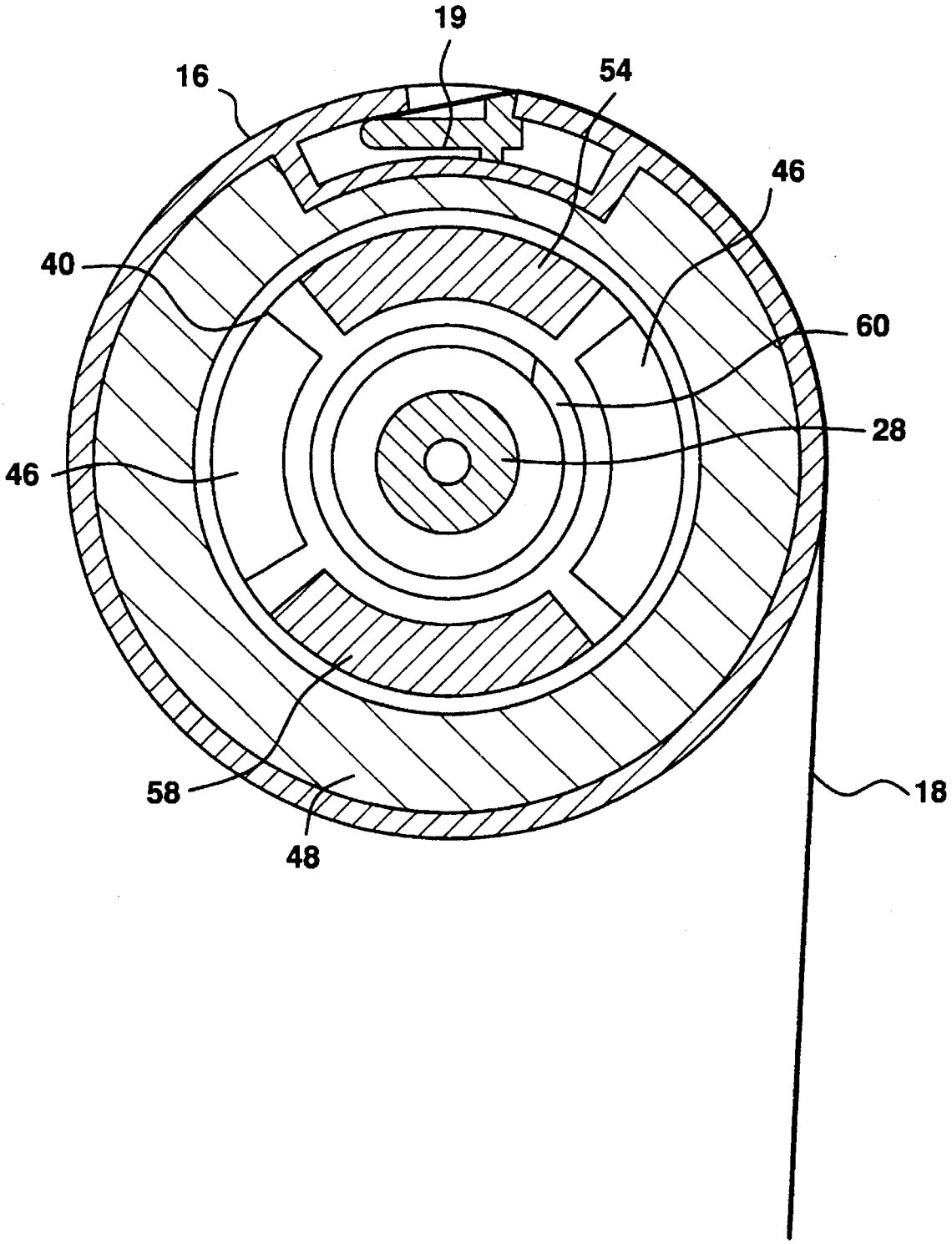
FIG. 4 is a cross section taken along the line 4—4 in FIG. 2.
Figure 15:
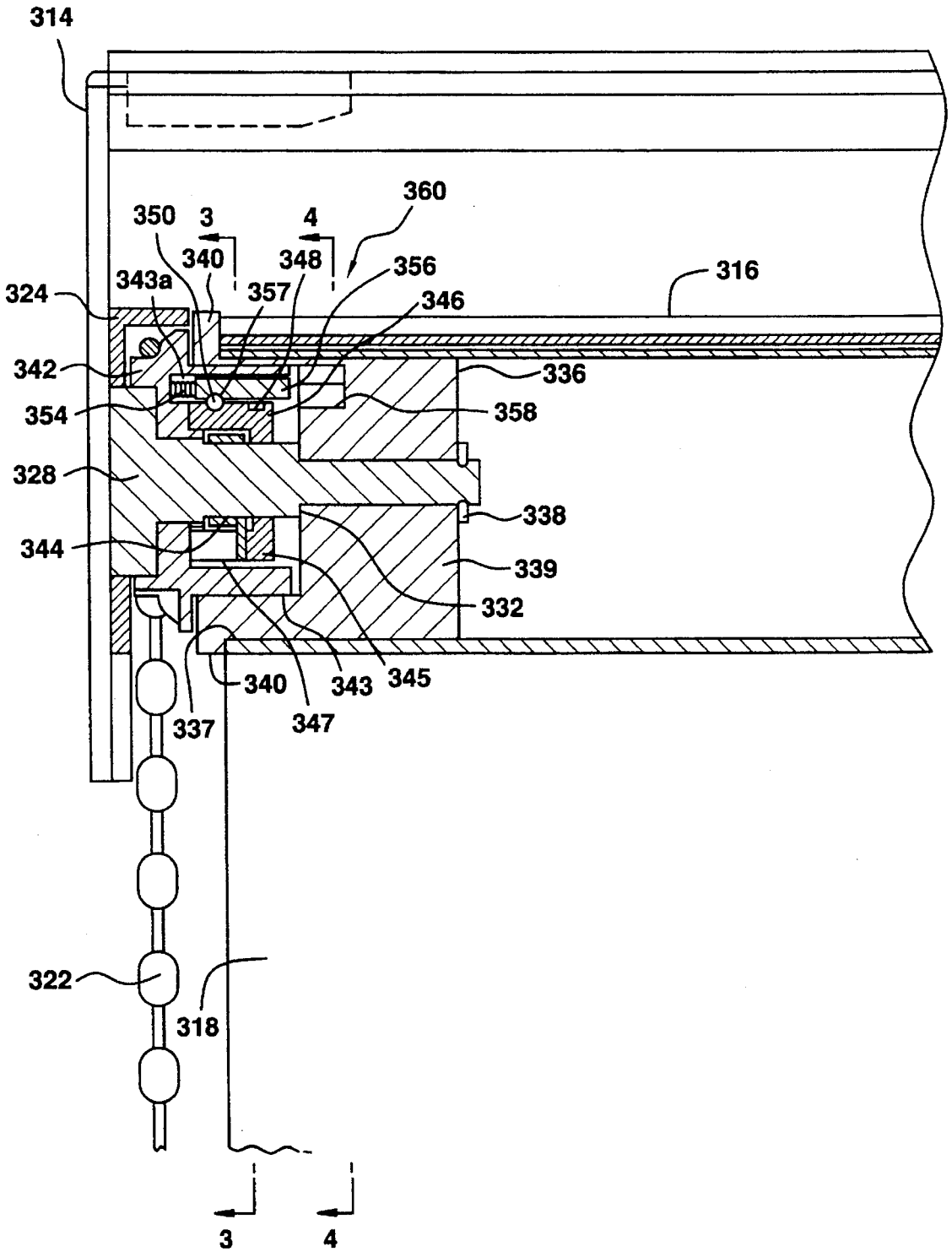
FIG. 15 is a longitudinal section of the left end of the roll screen apparatus of FIG. 14.
Figure 19:
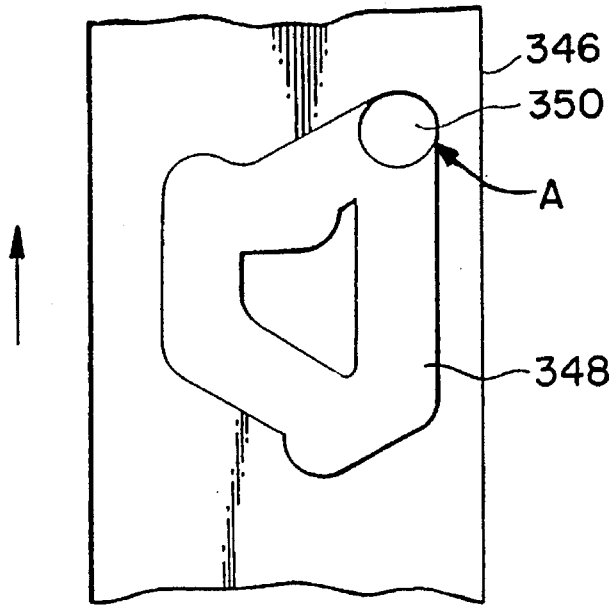
FIG. 19 shows that the ball stays at Stop Position A in the closed groove of the cam.

FIG. 15 shows, in section, the left end of the roll screen apparatus 310 of FIG. 1. A cylindrical plug 336 is press-fitted in the screen-winding pipe 316 so that it may rotate along with the screen-winding pipe 316 as a whole. The plug 336 has a collar 340 integrally connected to its opening end, and the plug 336 has a collar 340 integrally connected to its opening end, and the plug 336 is press-fitted in the screen-winding pipe 316 until its collar abuts on the left end of the screen-winding pipe 316, thereby preventing the axial displacement of the plug to the right. The enlarged head of the stationary axle 328 is fixed to the side plate 314, and the smallest-diameter section of round shank of the stationary axle 328 is inserted in the through hole of the bottom thickness 339 of the plug 336, thus permitting the plug 336 to rotate about the stationary axle 328. As seen from FIG. 4, three sector holes 358 are made at regular intervals on the inner surface of the bottom thickness of the plug 336. The shank of the stationary axle 328 is composed of large-, medium- and small-diameter circular sections, and the stationary axle 328 is prevented from axial displacement to the right with the shoulder 332 at the medium-to-small diameter transition caught by the inner surface of the bottom thickness 339 of the plug 336. The end of the stationary axle 328 has a pin 338 to prevent axial displacement of the plug 339 to the right. A pulley 342 is rotatably fixed to the large-diameter circular section of the shank of the stationary axle 328 so as to be adjacent to the wheel cover 324, which is fixed to the side plate 314. The cylindrical extension 343 of the pulley 342 is rotatably inserted in the hollow space of the cylindrical wall 337 of the plug 339. An operation chain 322 runs around the circumference of the pulley 342 for rotating it, and the operation chain 322 is prevented from slipping off from the circumference of the pulley 342 by the wheel cover 324, which is fixed to the side plate 314. A unidirectional clutch spring 344 is rotatably wound around the stationary axle 328 to be adjacent to the pulley 342. A cylindrical cam 346 has a through hole made in its closed end, and it is rotatably fixed to the stationary axle 328 with its cylindrical wall 347 encircling the unidirectional clutch spring 344. As is best shown in FIG. 3, one end 345 of the unidirectional clutch spring 344 is inserted in a radial hole of the cylindrical wall 347 of the cam 346. When the cam 346 presses against the end 345 of the unidirectional clutch spring 344 in the screen-unwinding direction, the coiled spring 344 expands radially until it can rotate about the stationary axle 328, thus rotating along with the cam 346 as a whole. On the contrary, when the cam 346 presses against the end 345 of the unidirectional clutch spring 344 in the screen-winding direction, the coiled spring 344 reduces radially until its winding tightens around the stationary axle 328, thus preventing it from rotating along with the cam 346. The cylindrical cam 346 has a closed groove 348 made on its outer circumference, as seen from FIG. 19. A ball 350 (movable element) is partly put in the closed groove 348, and an actuator member 356 is inserted in the space defined by a sector recess 343*a* of the pulley 342 and the circumference of the cam 346, permitting the actuator member 356 to move axially on the outer circumference of the cam 346, but preventing it from rotating with respect to the cam. The actuator member 356 is urged toward the plug 336 under the influence of a spring 354, which is positioned on the bottom of the sector recess 343*a* of the pulley 342 and behind the actuator member 356, and the actuator member 356 has a semi-spherical hole 357 made on its lower arcuate surface, thus permitting the ball 350 to rotatably fit in. When the actuator member 356 rotates along with the pulley 342, the ball 350 follows the closed groove 348 of the cam 346, thereby moving the actuator member 356 axially for getting in and out of a counter hole 358 of the plug 336. When the actuator member 356 gets in the counter hole 358 of the plug 336, the plug 336 is connected to the pulley 342 for rotating together as a whole. When the actuator member 356 gets out of the counter hole 358 of the plug 336, the plug 336 is disconnected from the pulley 342.

As may be understood from the above, a clutch device 360 is made up by the plug 336, the undirectional clutch spring 344, the cam 346, the closed groove 348, the ball 350, the spring 354 and the actuator member 356. The plug 336 provides a dual function of supporting the screen-winding pipe 316 and of transmitting the rotation of the clutch device 360 to the screen-winding pipe 316.

Now, the manner in which the roll screen apparatus works is described. When it is desired that the screen 318 is unwound from the screen-winding pipe, the operation side 322*a* of the operation chain 322 is pulled down in FIG. 16, thus rotating the pulley 342 in the screen-unwinding direction. Then, the actuator member 356 rotates along with the pulley 342, thereby causing the ball 350 to follow the closed groove 348 and stop at Stop Position A. The actuator member 356 rotates in the direction as indicated by arrow in FIG. 19, and therefore, the ball 350 cannot leave Stop Position A, staying there. As the ball 350 moves to Stop Position A, the actuator member 356 is axially moved to get in the counter hole 358 of the plug 336, thus connecting the pulley 342 to the plug 336 for rotating together as a whole, as seen from FIG. 18. Thus, rotation of the pulley 342 can be transmitted to the screen-winding pipe 316. As the cam 346 is connected to the actuator member 356 to rotate together as a whole in the screen-unwinding direction, the cam 346 presses against the unidirectional clutch spring 344 to radially expand until the coiled spring 344 can rotate around the stationary axle 328, thus permitting the cam 346 to rotate freely along with the pulley 342. So long as the pulling-down of the operation side 322*a* of the operation chain 322 continues, the pulley 342 rotates continuously, unwinding the screen 318 from the screen-winding pipe 316.

Figure 20:
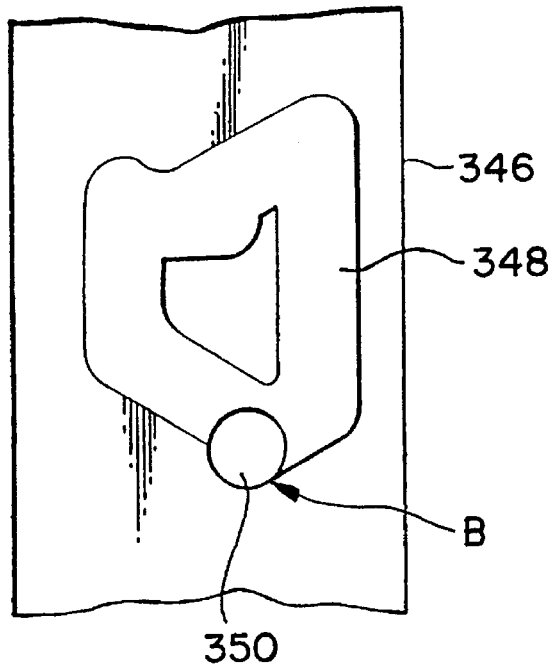
FIG. 20 shows that the ball stays at Stop Position B in the closed groove of the cam.

When it is desired that the unwinding of the screen 318 is made to stop before being unwound to the end, the hold is lost on the operation side 322*a* of the operation chain 322 to stop rotation of the pulley 342. Then, the screen-winding pipe 316 starts rotation in the screen-winding direction under the resilient influence of the winding spring, thus transmitting the screen-winding force to the pulley 342 via the actuator member 356, which is inserted in the counter hole 358 of the plug 336. Then, the cam 346 presses against the end 345 of the unidirectional clutch spring 344 in the screen-winding direction to tighten around the stationary axle 328, thereby preventing the coiled spring 344 from rotating around the stationary axle 328. The ball 350 moves from Stop Position A in FIG. 19 to Stop Position B in FIG. 20 to prevent further revolution of the actuator member 356 with respect to the cam 346. As a result, the plug 336, being connected to the actuator member 356, cannot rotate. Thus, the screen 318 stops on the way to the complete unwinding.

Figure 21:
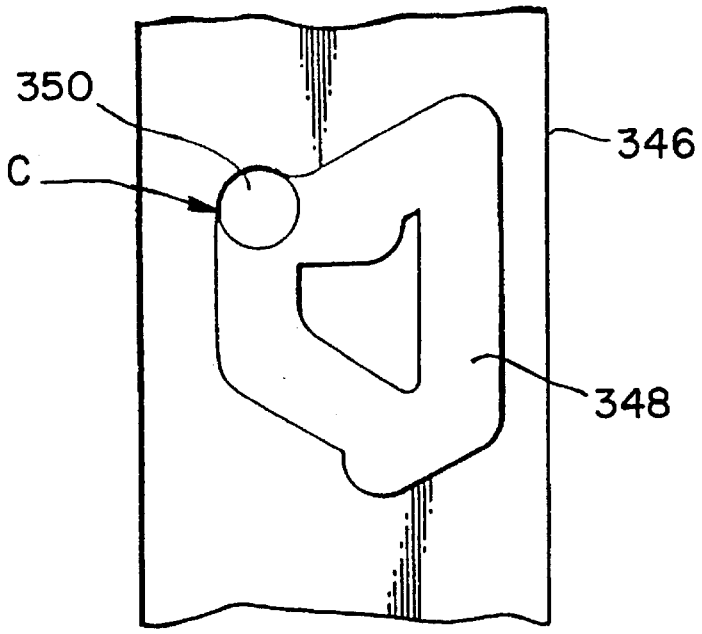
FIG. 21 shows that the ball stays at Stop Position C in the closed groove of the cam.

When it is desired that the screen 318 is wound on the screen-winding pipe 316, the operation side 322*a* of the operation chain 322 is pulled down a predetermined length to rotate the pulley 342 accordingly in the screen-unwinding direction. Then, the actuator member 356 rotates along with the pulley 342, to cause the ball 350 to move from Stop Position B in FIG. 20 to Stop Position C in FIG. 21. As a result, the actuator member 356 is brought to the left in FIG. 5, leaving the counter hole 358 of the plug 336, thereby disconnecting the pulley 342 from the plug 336 as shown in FIG. 15. Thus, the plug 336, and hence the screen-winding pipe 316 rotates freely in the screen-winding direction under the influence of the winding spring. All this while a pulling force is applied to keep the operation side 322*a* of the operation chain 322 at the pull-down position, thereby continuing application of the force to the pulley 342 in the screen-unwinding direction to allow the ball 350 to stay in Stop Position C in FIG. 2, in which position the pulley 342 is disconnected from the plug 336, thereby permitting the winding-up of the screen 318 on the screen-winding pipe 316.

Figure 22:
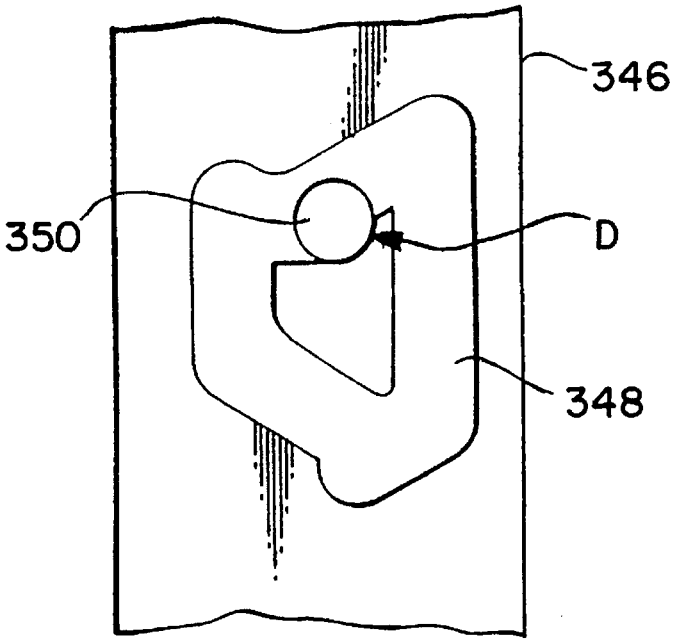
FIG. 22 shows that the ball stays at Stop Position D in the closed groove of the cam.

When it is desired that the winding of the screen 318 is made to stop in the course of winding up, the hold is lost on the operation side 322*a* of the operation chain 322 to remove the exterior force from the pulley 342, which exterior force is directed in the screen unwinding direction. As a result, the actuator member 356 cannot apply to the ball 350 a force strong enough to retain the ball 350 at Stop Position C in FIG. 21, and therefore, the actuator member 356 is brought toward the plug 336 under the resilient influence of the spring 354 to get in the counter hole 358 of the plug 336. Accordingly the ball 350 is brought from Stop Position C (FIG. 21) to Stop Position D (FIG. 22), and staying there. Thus, the pulley 342 is connected to the plug 336 for preventing relative rotation whereas the pulley 342 is connected to the cam 346 for preventing relative rotation. Then, the screen-winding pipe 316 is "eager" to rotate in the screen-winding direction under the resilient influence of the winding spring, and therefore, the rotating force is transmitted to the pulley 342 via the actuator member 356, and at the same time to the cam 346 via the ball 350. The cam 46 presses against the end 345 of the unidirectional clutch spring 344 in the screen-winding direction to cause its coil to tighten around the stationary axle 328, and therefore, the cam 346 cannot rotate around the stationary axle 328. Thus, the actuator member 356 cannot rotate relative to the stationary axle 328, and therefore, the screen-winding pipe 316 cannot rotate, thus stopping the winding of the screen 318 on the way to the complete winding-up.

As is the case with the stopping of the winding-up of the screen in the course of winding just described, after the screen-winding pipe 316 has completed the winding-up of the screen 318, the hold is lost on the operation side 322*a* of the operation chain 322, thereby allowing the actuator member 356 to get in the counter hole 58 of the plug 336, and at the same time, allowing the ball 350 to move from Stop Position C (FIG. 21) to Stop Position D (FIG. 22) and stay there.

Figure 18:
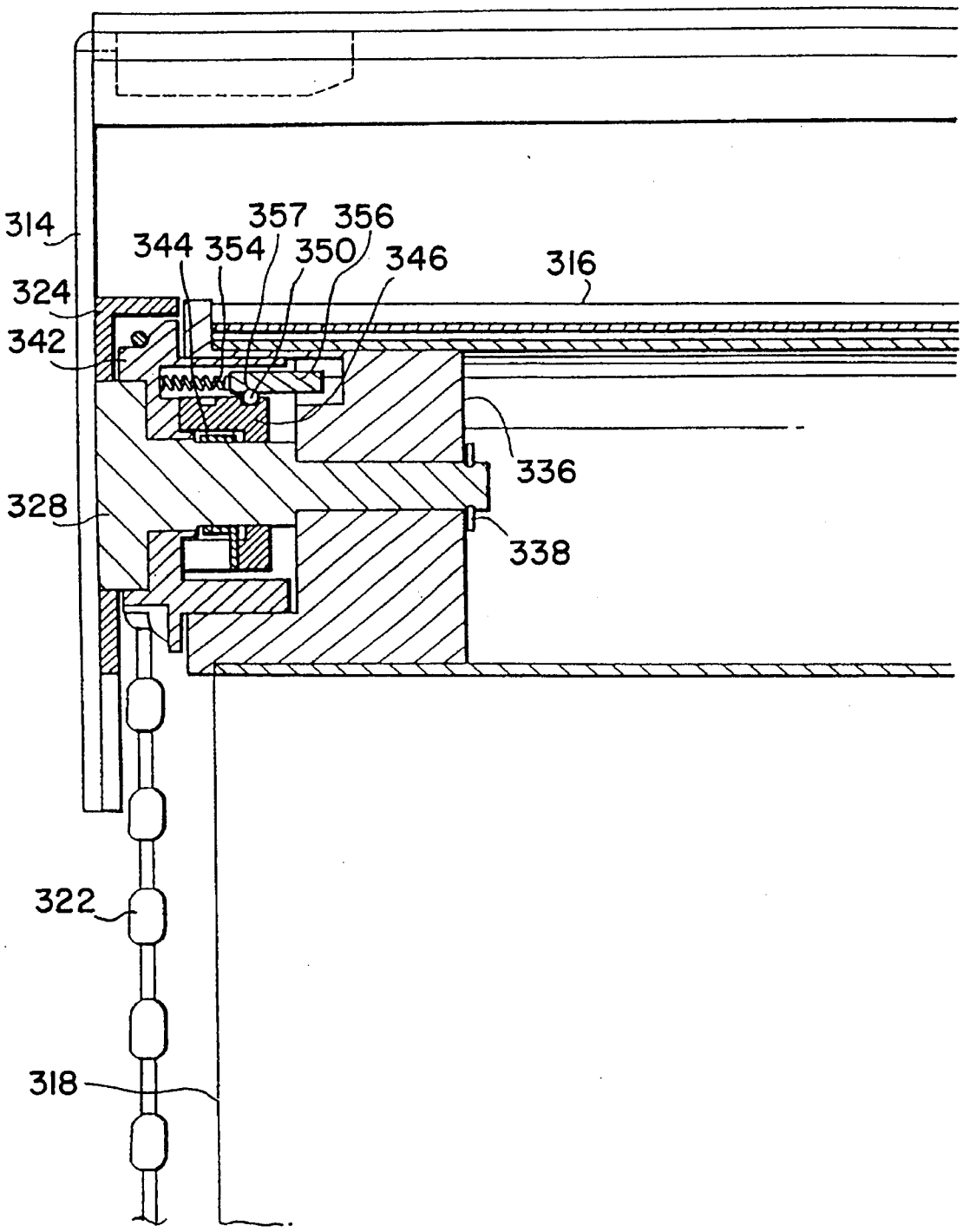
FIG. 18 is similar to FIG. 15, showing that the actuator member gets in the counter hole of the plug.

When it is desired that the unwinding of the screen 318 starts from the stop position in the course of winding or from the position in which the screen 318 is completely wound up, the operation side 322*a* of the operation chain 322 is pulled down to rotate the pulley 318 in the direction in which the screen 318 is unwound, and then, the actuator member 356 rotates along with the pulley 342. The ball 50 follows the closed groove 348 of the cam 346, moving form Stop Position D (FIG. 22) to Stop Position A (FIG. 19) so that the actuator member 356 gets in the counter hole 358 still deeper, as shown in FIG. 18. As is the case with the unwinding of the screen 318 as described above, the screen 318 is unwound from the screen-winding pipe 316 to descend.

ADVANTAGES OF THE THIRD EMBODIMENT

A clutch device according to the present invention is so constructed that the pulley can be connected to the plug when the actuator member is permitted to move under the resilient influence of a spring; and that required connection and disconnection can be made by moving the actuator member through the agency of movable element, which follows the closed groove of the cam when the pulley rotates. Such clutch device is simple in structure, requiring a least number of parts. Accordingly, the assembling requires no tedious, complicated work, and therefore, the productivity rate increases and accordingly, the manufacturing cost decreases.

FORTH EMBODIMENT

Figure 23:
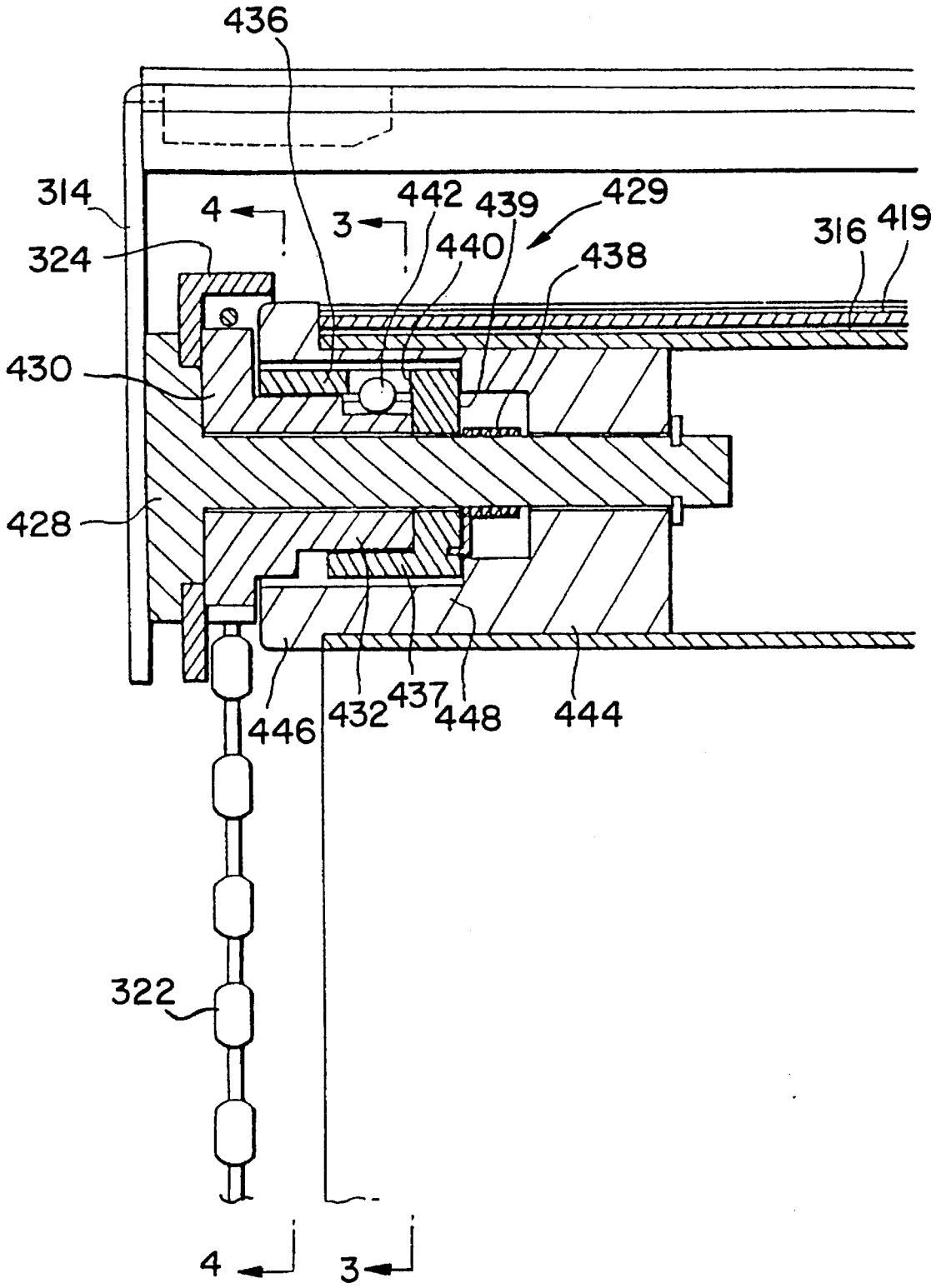
FIG. 23–27 show the forth embodiment.
Figure 24:
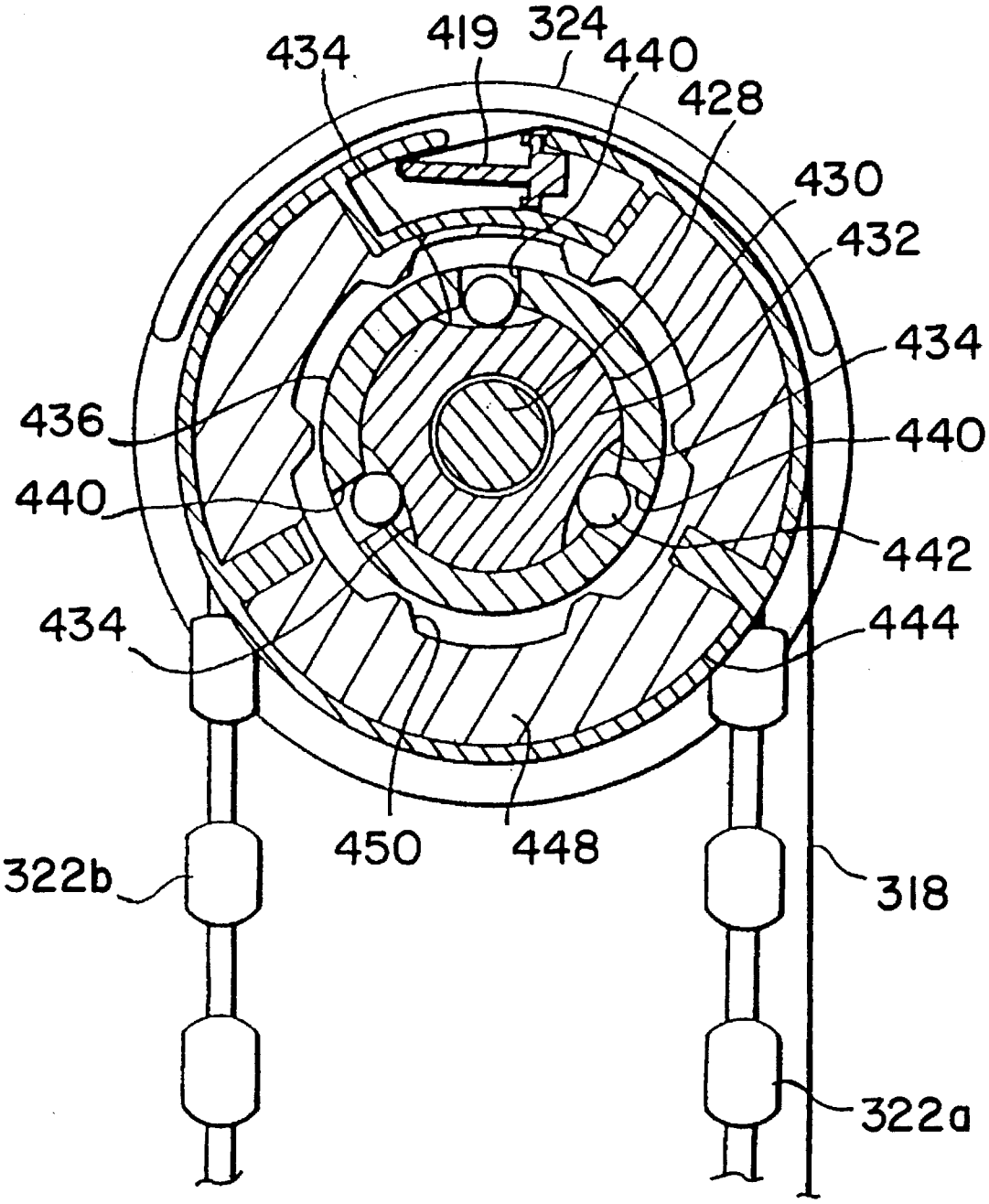
Figure 25:
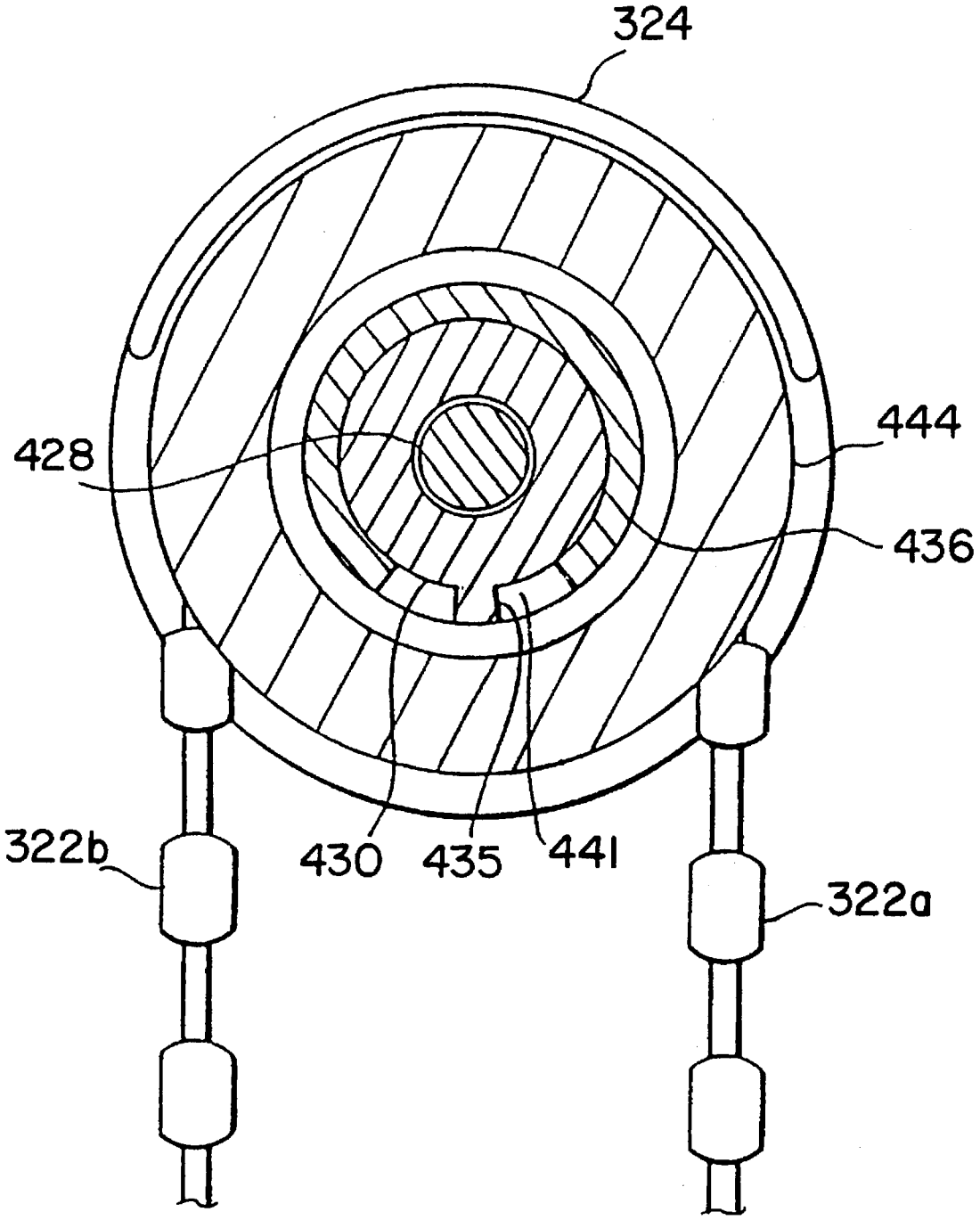

FIG. 23 shows, in section, the left end of the roll screen apparatus. A stationary axle 428 is fixed to the side plate 314, extending in the screen-winding pipe 316 in coaxial relationship. The stationary axle 428 has a clutch device 429 in the vicinity of the side plate 314. The clutch device 429 is designed to control rotation of the screen-winding pipe 316, and is composed of a rotational cylinder 436, a unidirectional clutch spring 438, engagement members in the form of balls 442 and a plug 444 in addition to the pulley 430. The pulley cover 324 is fixed to the stationary axle 428 on the side of the side plate 314. The pulley 430 is rotatably fixed to the stationary axle 428. Specifically, the outer, large-diameter section of the pulley 430 is put close to the enlarged head of the stationary axle 428, and the inner, small-diameter section 432 of the pulley 430 surrounds the shank of the stationary axle 428, extending in the screen-winding pipe 316 in coaxial relationship. The inner, small-diameter section 432 of the pulley 430 has three arcuate recesses 434 made at regular intervals on its circumference. The inner, small-diameter section 432 of the pulley 430 has a radial projection 435 at its rear end, and the chain 322 runs around the circumference of the outer, large-diameter section of the pulley 430 to permit rotation of the pulley 430 by pulling down the chain 322. The rotational cylinder 436 is a hollow cylinder closed at its rear end, and the small-diameter section 432 of the pulley 430 is rotatably fitted in the hollow space of the rotational cylinder 436, which, in turn, is rotatably fitted in the hollow space of the plug 444. The rotational cylinder 436 has three radial holes 440 made at the same intervals as the arcuate recesses 434 of the small-diameter section 432 of the pulley 430. As seen from FIG. 23 the open end of the rotational cylinder 436 has a notch 441 formed in its circumference, and the radial projection 435 of the pulley 430 is put in the notch 441, thereby permitting the pulley 430 to rotate the predetermined angle relative to the rotational cylinder 436 (FIG. 25). The unidirectional clutch spring 438 is wound around the shank of the stationary axle 428 in the vicinity of the closed end 439 of the rotational cylinder 436. One end of the unidirectional clutch spring 438 is caught by the rotational cylinder 436. The coiled spring 438 is responsive to rotation of the rotational cylinder 436 in the screen-unwinding direction for radially expanding, thereby unclutching the rotational cylinder 436 from the stationary axle 428, and the coiled spring 438 is responsive to rotation of the rotational cylinder 436 in the screen-winding direction for radially reducing, thereby clutching the rotational cylinder 436 to the stationary axle 428. Balls 442 are movably fitted in the radial holes 440 of the rotational cylinder 436, and these balls 442 are movable both radially in the radial holes 440 and circumferentially along the outer circumference of the small-diameter section 432 of the pulley 430. The plug 444 is a hollow cylinder having a bottom at its rear end and a collar 446 at its front end. The rotational cylinder 436 is rotatably fitted in the hollow space of the plug 444, and the plug 444 is press-fitted in the screen-winding pipe 316 until the collar 446 of the plug 444 has come to abut on the screen-winding pipe 316, thus permitting the plug 444 and the screen-winding pipe 316 to rotate as a whole. The plug 444 has six radial projections 450 at regular intervals on its inner circumference, as best seen from FIG. 24.

Figure 27:
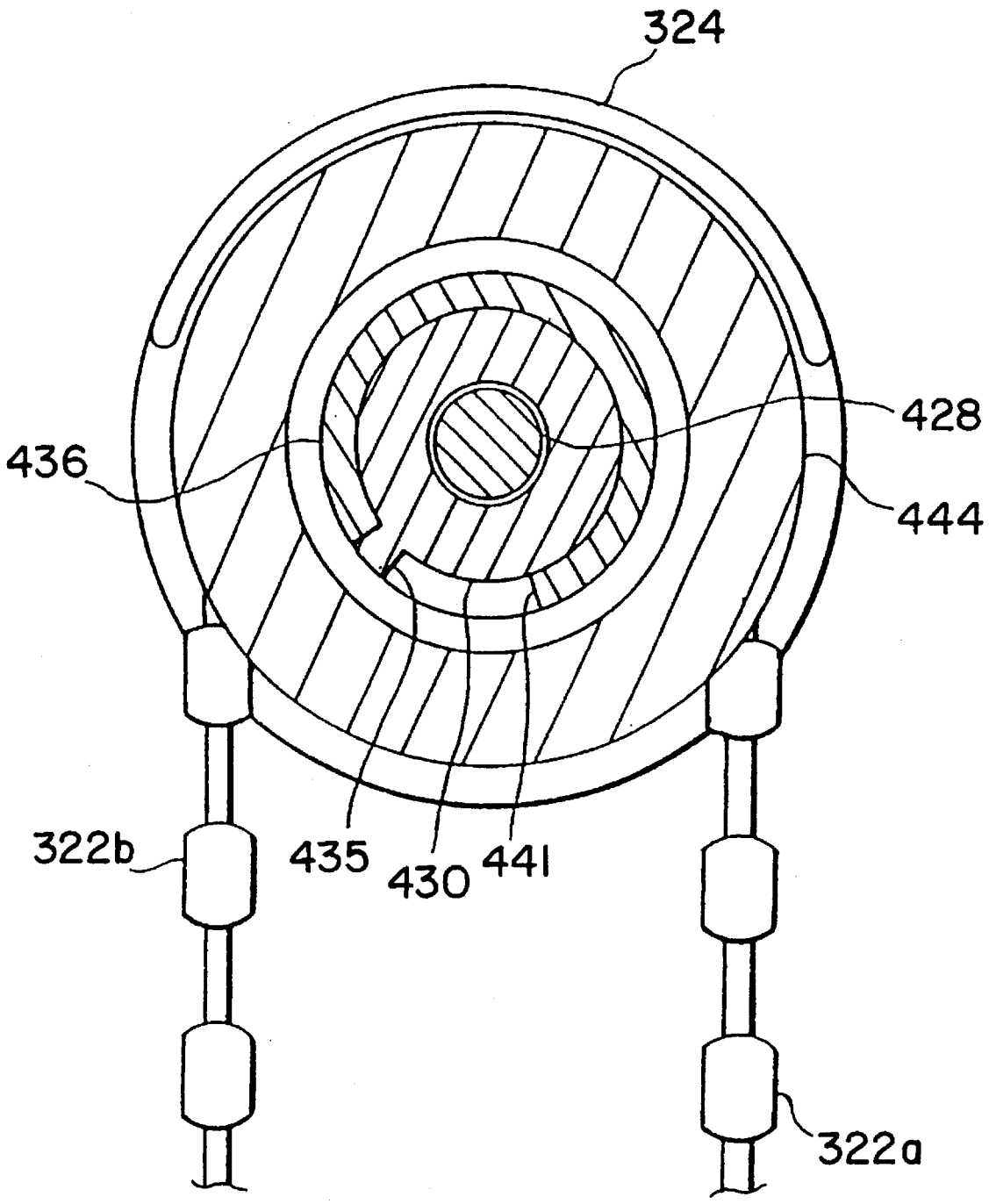

Now, the manner in which the roll screen apparatus works is described. When it is desired that the screen 318 is unwound from the screen winding pipe 316, which remains in the stopping condition as shown in FIG. 24, the unwinding or "down" side 322*a* of the chain 322 is pulled down to rotate the pulley 430 clockwise, thus causing the radial projection 435 of the pulley 430 to move from the position shown in FIG. 25 to the position shown in FIG. 27, where the radial projection 435 of the pulley 430 abuts against one extreme end of the notch 441 of the rotational cylinder 436, thereby coupling the pulley 430 with the rotational cylinder 436 to permit them to rotate clockwise together. Thus, the rotating force is applied from the pulley 430 to the rotational cylinder 436, rotating the rotational cylinder 436 clockwise in FIG. 27, and accordingly, the unidirectional clutch spring 438 is radially expanded by force until the rotational cylinder 436 is unlatched from the stationary axle 428, thereby allowing the rotational cylinder 436 to rotate freely about the stationary axle. Thus, the pulley 430 can be continuously rotated clockwise in FIG. 24. On the other hand, while the pulley 430 is rotated a given angular distance relative to the rotational cylinder 436 (from the position of FIG. 25 to the position of FIG. 27), the balls 442 are pushed out by the inclined surfaces of the arcuate recesses 434 of the small-diameter section 432 of the pulley 430 to travel along the radial holes 440 outward. As mentioned earlier, the pulley 430 is connected to the rotational cylinder 436 to rotate together, permitting the balls 442 to revolve clockwise together with the rotational cylinder 436 until the balls 442 come to contact selected radial projections 450 of the plug 444. Thus, the rotational cylinder 436 and the plug 444 are coupled together to permit them to rotate as a whole. Then, rotation of the pulley 430 can be transmitted to the screen-winding pipe 316 to unwind the roll of screen from the screen-winding pipe 316.

When it is desired that the unwinding of the wound screen is made to stop or that the screen 318 is kept extensive to its full length after being unwound to the end, rotation of the pulley 430 is made to stop by losing the hold on the unwinding or "down" side 322*a* of the chain 322, thereby allowing the screen-winding pipe 316 and the plug 444 to rotate in the screen-winding direction (counterclockwise in FIG. 26) under the influence of resilient bias. The plug 444 remains integral with the rotational cylinder 436 with the balls 442 intervening between selected radial projections 450 of the plug 444 and the radial holes 440 of the rotational cylinder 436, and therefore, the rotational cylinder 436 along with the pulley 430 are likely to rotate in the screen-winding direction with the result that the rotating force is applied to the rotational cylinder 436 in the screen-winding direction, thereby causing the rotational cylinder 436 to apply a tightening force to the unidirectional clutch spring 438 to fix the rotational cylinder 436 to the stationary axle 428, thus preventing the rotational cylinder 436 from rotating. As a result, the plug 444 and hence the screen-winding pipe 316 are prevented from rotating, remaining in the conditions shown in FIGS. 26 and 27.

Figure 26:
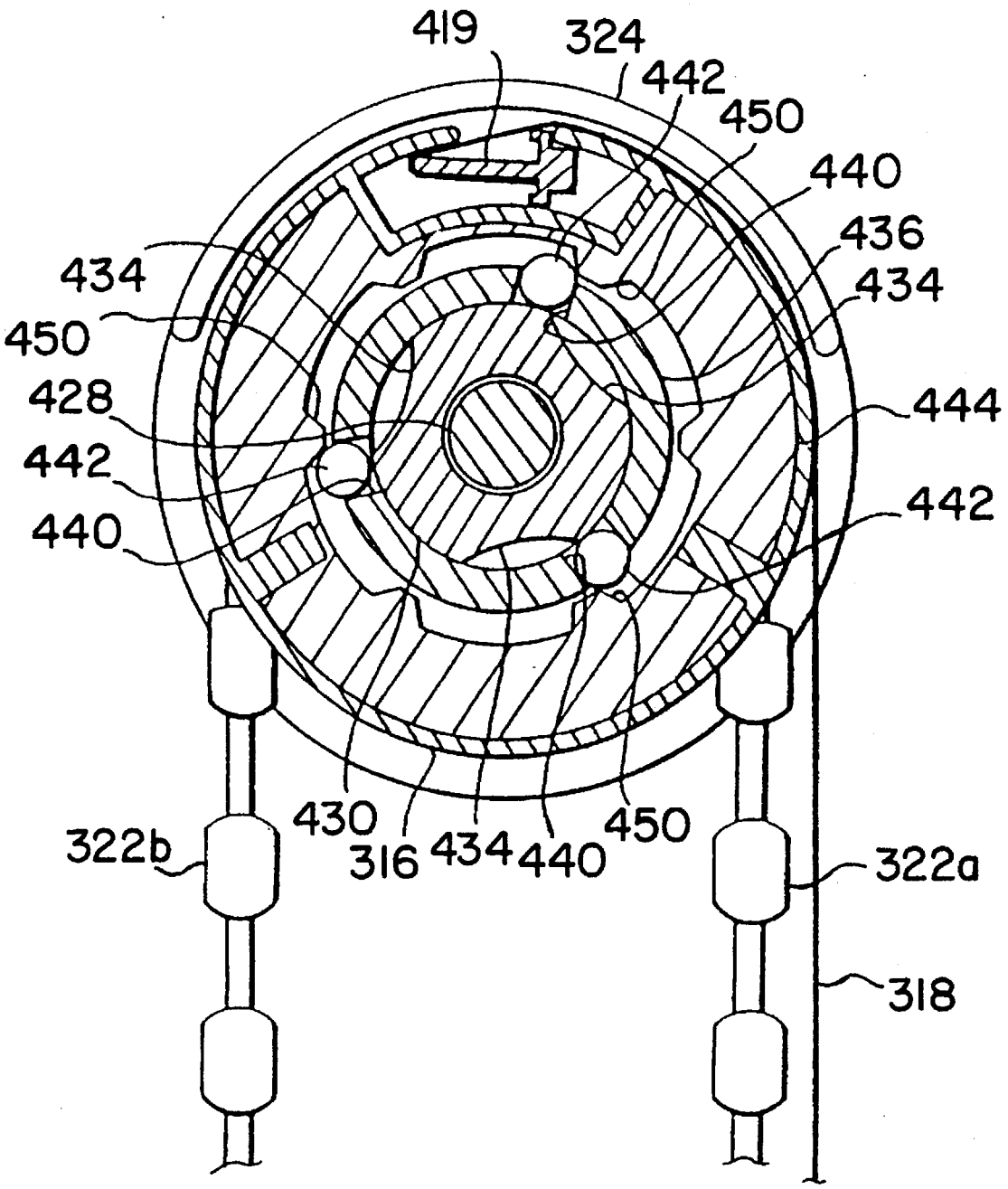

When it is desired that the screen 418 is wound up, starting from the position of FIG. 26, the winding or "up" side 322*b* of the chain is pulled down somewhat, thereby causing the pulley 430 to rotate counterclockwise so that the arcuate recesses 434 of the pulley 430 are put in alignment with the radial holes 410 of the rotational cylinder 436. Thus, the balls 442 are allowed to fall in the arcuate recesses 434 of the pulley 430, thereby disconnecting the rotational cylinder 436 from the plug 444, and then the plug 444 and the screen-winding pipe can rotate freely under the influence of the resilient bias. Even if the pulling-down of the "up" side 322*b* of the chain stops by losing the hold on the chain, the screen-winding pipe 316 rotates clockwise freely under the influence of the resilient bias, thus winding up the screen 318 continuously. In this winding position the radial projection 435 of the pulley 430 is shifted to the position of FIG. 25 where the pulley 430 can rotate relative to the rotational cylinder 436.

Finally, when it is desired that the screen is made to stop in the course of winding, the unwinding or "down" side 322*a* of the chain is pulled down somewhat, thereby causing the pulley 430 to rotate clockwise in FIG. 24. The clockwise rotation of the pulley 430 relative to the rotational cylinder 436 causes the balls 442 to rise in the radial holes 440 until these balls 442 come to contact selected radial projections 450 of the plug 444 as shown in FIG. 26, and then, the plug 444 starts rotating clockwise. The screen-winding force is applied to the rotational cylinder 436, causing the unidirectional clutch spring 438 to reduce radially until the rotational cylinder 436 is seized by the stationary axle 428. As a result, the rotational cylinder 436 is prevented from rotating, and therefore the plug 444 and the screen-winding pipe 316 are prevented from rotating.

FIFTH EMBODIMENT

Figure 28:
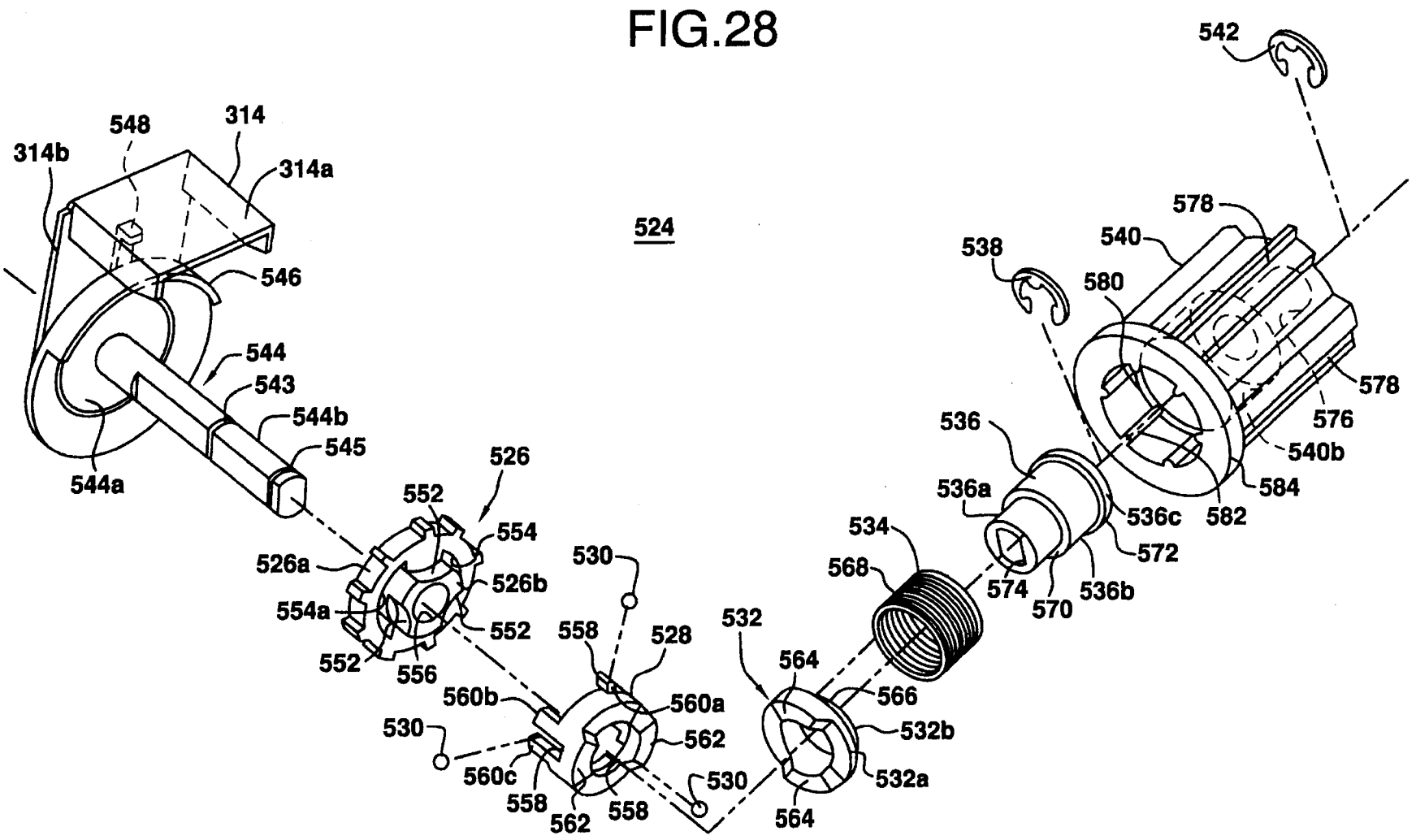
FIG. 28 is a perspective, exploded view of a clutch unit in the fifth embodiment.

FIG. 28 is a perspective, exploded view of a clutch device 524, which is positioned at the left end of the screen-winding pipe 316 in FIG. 14. The clutch device 324 is composed of a stationary axle 544, a pulley 526, a clutch piece 528, engagement elements 530, a counter clutch piece 532, a unidirectional clutch spring 534, a clutch spring holder 536, a first "E"-shaped ring 538, a plug 540 and a second "E"-shaped ring 542.

The side plate 314 is composed of a joint piece 14*a* to be connected to the frame 312 and a bearing piece 314*b* to bear the screen-winding pipe 316. The stationary axle 544 is fixed to the bearing piece 314*b* of the side plate 314, extending in the screen-winding pipe. 316. The stationary axle 544 is composed of an enlarged head 544*a* and a shank 544*b* integrally connected to the enlarged head 544*a*. The enlarged head 544*a* of the stationary axle 544 is fixed to the bearing piece 314*b* of the side plate 314. The shank 544*b* is composed of a predetermined axial length of round section and the remaining axial length of non-round section, which has alternate arcuate and flat surfaces on its circumference. The shank 544*b* has two grooves 543 and 545 for the first and second "E"-shaped rings 538 and 542 to resiliently fit in. The wheel cover 546 is rotatably fitted on the enlarged head 544*a* of the stationary axle 544. Also, the enlarged head 544*a* has a notch 544*c* made at its crest, and a pusher 548 is inserted in the notch 544*c*, and is urged upward by a spring 550, which is put between the bottom end of the pusher 548 and the bottom of the notch 544*c*. Thus, the shoulder 548*a* of the pusher 548 pushes up the wheel cover 546 all the time, as seen from FIG. 29. The wheel cover 546, therefore, is prevented from rotating.

The pulley 526 comprises a large-diameter circular section 526*a* and a small-diameter circular section 526*b*. The large-diameter circular section 526*a* has indentations on its circumference to catch the ball-connected chain 322 whereas the small-diameter circular section 526*b* has three curved recesses 552 made at regular intervals on its circumference. Also, the large-diameter circular section 526*a* has two arcuate apertures 554*a* and 554*b*. Each arcuate aperture spans one curved recess and an adjacent recess-free arc. The pulley 526 has a through hole 556 at its center to fit on the round section of the stationary axle 544.

The clutch piece 528 has three longitudinal legs 560*a*, 560*b* and 560*c* to define three longitudinal spaces 558 therebetween to receive engagement elements 530 in the form of balls. The longitudinal leg 560*a* of the clutch piece 528 is movably inserted in the arcuate aperture 54*b* of the pulley 526 whereas the longitudinal legs 560*b* and 560*c* of the clutch piece 528 are movably inserted in the arcuate aperture 554*a* of the pulley 526. The clutch piece 528 has two tapering projections 562 positioned symmetrically relative to its center on the side which is opposite to the side facing the pulley 526.

The counter clutch piece 532 comprises a large-diameter circular section 532*a* having the same diameter as the clutch piece 528 and a small-diameter circular sections 532*b*. The large-diameter circular section 532*a* has two tapering projections 564 on the side facing the clutch piece 528. The clutch piece 528 and the counter clutch piece 532 can be coupled with their tapering projections abutting on each other after relative rotation over a predetermined angle. The large-diameter circular section 532*a* has a hole 566 made on the side which is opposite to the side on which the tapering projections 564 are formed, and a nail 586 of the clutch spring 534 is inserted into the hole 566 as described below.

The unidirectional clutch spring 534 is a coiled spring, one end of which is formed into a nail 568 by bending and extending axially.

The clutch spring holder 536 is a three-stepwise hollow cylinder, which comprises a small-diameter circular section 536*a*, a medium-diameter circular section 536*b* and a large-diameter circular section 536*c* with shoulders 570 and 572 formed at the small-to-medium and medium-to-large diameter transients. The clutch spring holder 536 has a through hole 574 to fit on the non-round section of the stationary axle 544.

The plug 540 is a cylinder having a large-diameter hollow space 540*b* and a small-diameter through hole 576 to rotatably receive the non-round section of the stationary axle 544. The large-diameter hollow space 540*b* of the plug 540 has a somewhat reduced diameter at a predetermined distance from the opening end to define a shoulder 580, and a plurality of longitudinal spline-like ridges 582 are formed on the inner surface of the plug cylinder 540. A collar 584 is integrally connected to the opening end of the plug cylinder 540, and a plurality of longitudinal spline-like ridges 578 are formed on the outer surface of the plug cylinder 540.

Figure 29:
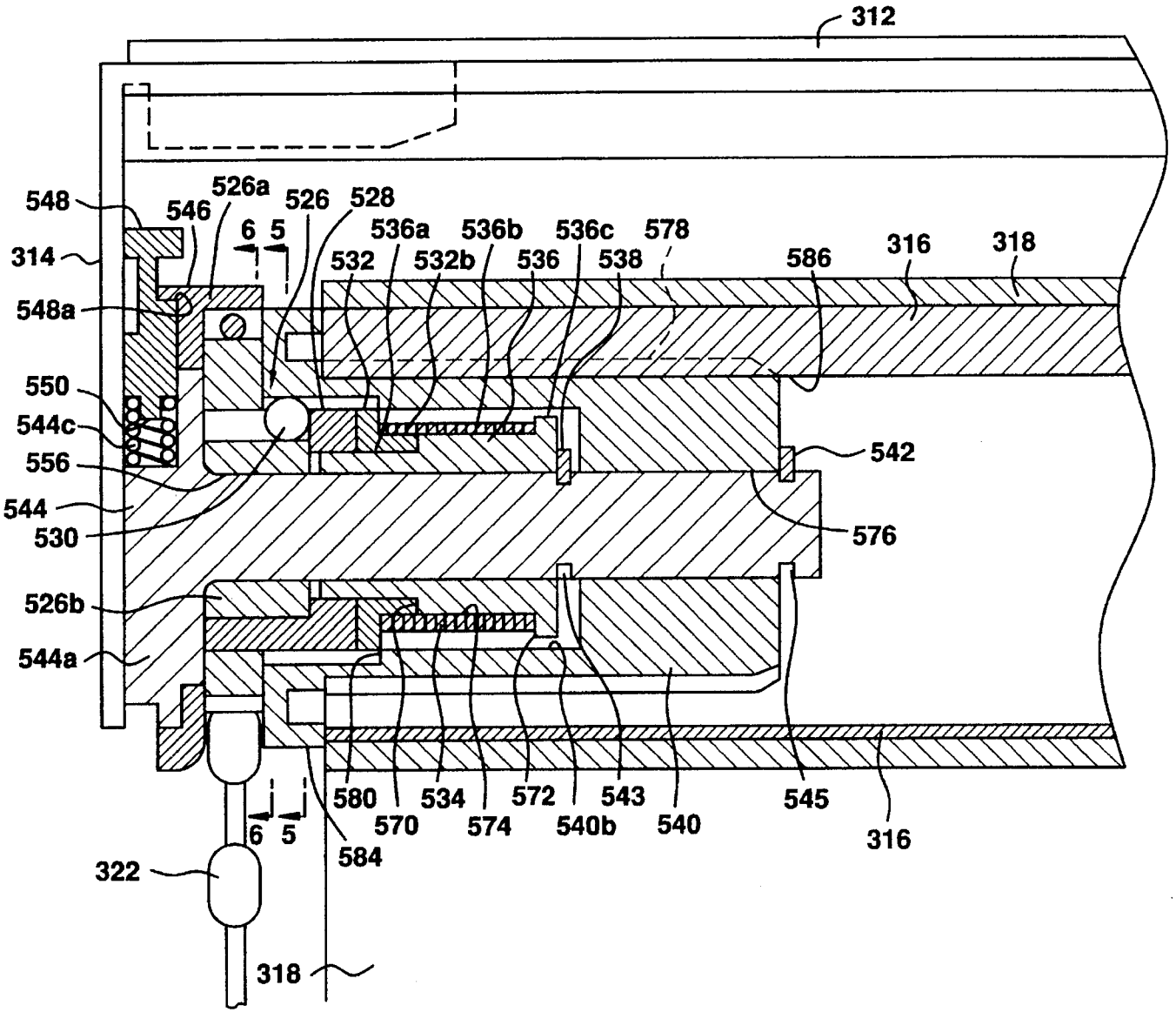
FIG. 29 is a longitudinal section of the left end of the roll screen apparatus of FIG. 14.

FIG. 29 shows, in section, a clutch device which is provided by assembling the above described parts.

As shown in the drawing, the side plate 314 is fixed to the frame 312 by connecting its joint piece 314*a* to the frame 312.

The pulley cover 546 and the pusher 548 are attached to the stationary axle 544 as described earlier.

The pulley 526 is rotatably fixed to the stationary axle 544 by inserting the round section of the stationary axle 544 in the through hole 556 of the pulley 526, and the operation chain 322 runs around the large-diameter circular section 526*a* of the pulley 526.

The clutch spring holder 536 is non-rotatably fixed to the stationary axle 544 by inserting the non-round section 544*b* of the stationary axle 544 in the through hole 574 of the clutch spring holder 36 with its small-diameter circular section 536*a* positioned adjacent to the pulley 526.

Figure 30:
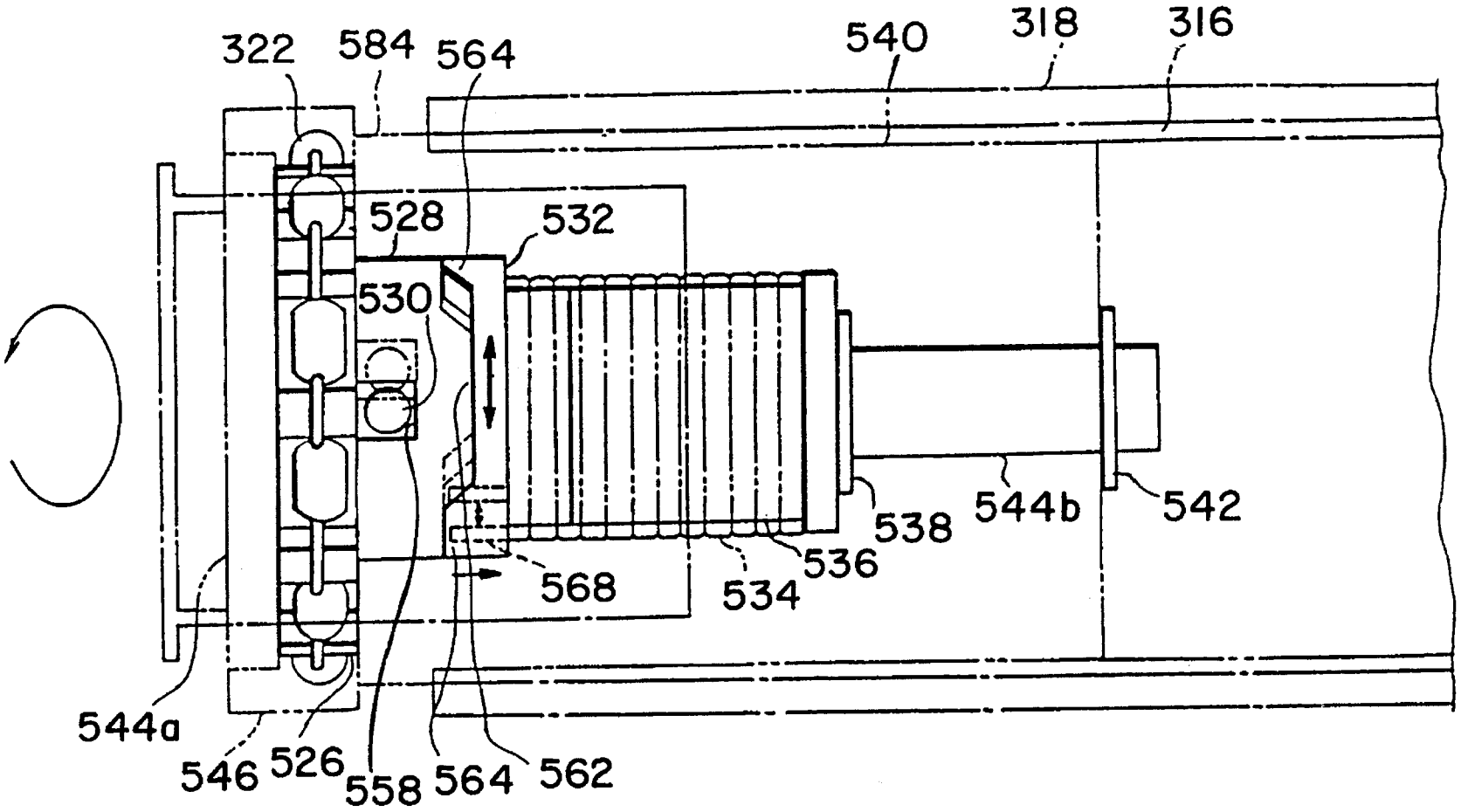
FIG. 30 shows how the clutch unit works.

The small-diameter circular section 536*a* of the clutch spring holder 536 is inserted in the counter clutch piece 532 and the clutch piece 528 so as to permit rotation of these pieces about the small-diameter circular section 536*a* of the clutch spring holder 536. As seen from FIG. 30, the counter clutch piece 532 and the clutch piece 528 are put close together with their tapering projections 562 and 564 adjacent to each other. The counter clutch piece 532 and the clutch piece 528 are sandwiched between the shoulder 570 of the clutch spring holder 536 and the pulley 526, thus preventing displacement of these pieces along the stationary axle 544.

The unidirectional clutch spring 534 is fitted on the medium-diameter circular section 536*b* of the clutch spring holder 536 and the small-diameter circular section 532*b* of the counter clutch piece 532. The nail 568 of the unidirectional clutch spring 534 is inserted into the hole 566 of the counter clutch piece 532, and the unidirectional clutch spring 534 is sandwiched between the large-diameter circular section 532*a* of the counter clutch piece 532 and the large-diameter circular section 536*c* of the clutch spring holder 536, thus preventing displacement of the unidirectional clutch spring 534 along the stationary axle 544. When the counter clutch piece 532 rotates in the unwinding direction in which the screen 318 is unwound, the unidirectional clutch spring 534 is radially expanded and loosened to disconnect the counter clutch piece 532 and the clutch spring holder 536 from each other whereas when the counter clutch piece 532 rotates in the winding direction in which the screen 318 is wound, the unidirectional clutch spring 534is radially reduced and tightened to connect the counter clutch piece 532 and the clutch spring holder 536 together.

The first "E"-shaped ring 538 is fitted in the groove 543 of the stationary axle 544 to be close to the end surface of the large-diameter circular section of the clutch spring holder 536, thereby preventing displacement of the clutch spring holder 36 along the stationary axle 544.

The clutch piece 528, the counter clutch piece 532, the clutch spring holder 536, the unidirectional clutch spring 534 and the first "E"-shaped ring 538 are put in the hollow space 540*b* of the plug 540, and the plug 540 is rotatably fixed to the stationary axle 544. The second "E"-shaped ring 542 is fitted in the groove 545 of the stationary axle 544 to be close to the end surface of the plug 540, thereby preventing rightward displacement of the plug 540 along the stationary axle 544.

The collar 584 of the plug 540 abuts on the large-diameter circular section 526*a* of the pulley 526, thereby preventing the leftward displacement of the plug 540 along the stationary axle 544. The plug 540 is integrally connected to the screen-winding pipe 316 by inserting the longitudinal ridges 586 of the inner surface of the screen-winding pipe 316 into the longitudinal slots 578 of the outer surface of the plug 540, as seen from FIG. 29. Thus, the plug 540 and the screen-winding pipe 316 can rotate as a whole. The screen-winding pipe 316 abuts on the collar 584 of the plug 540 to prevent the leftward displacement along the stationary axle 544.

Figure 31:
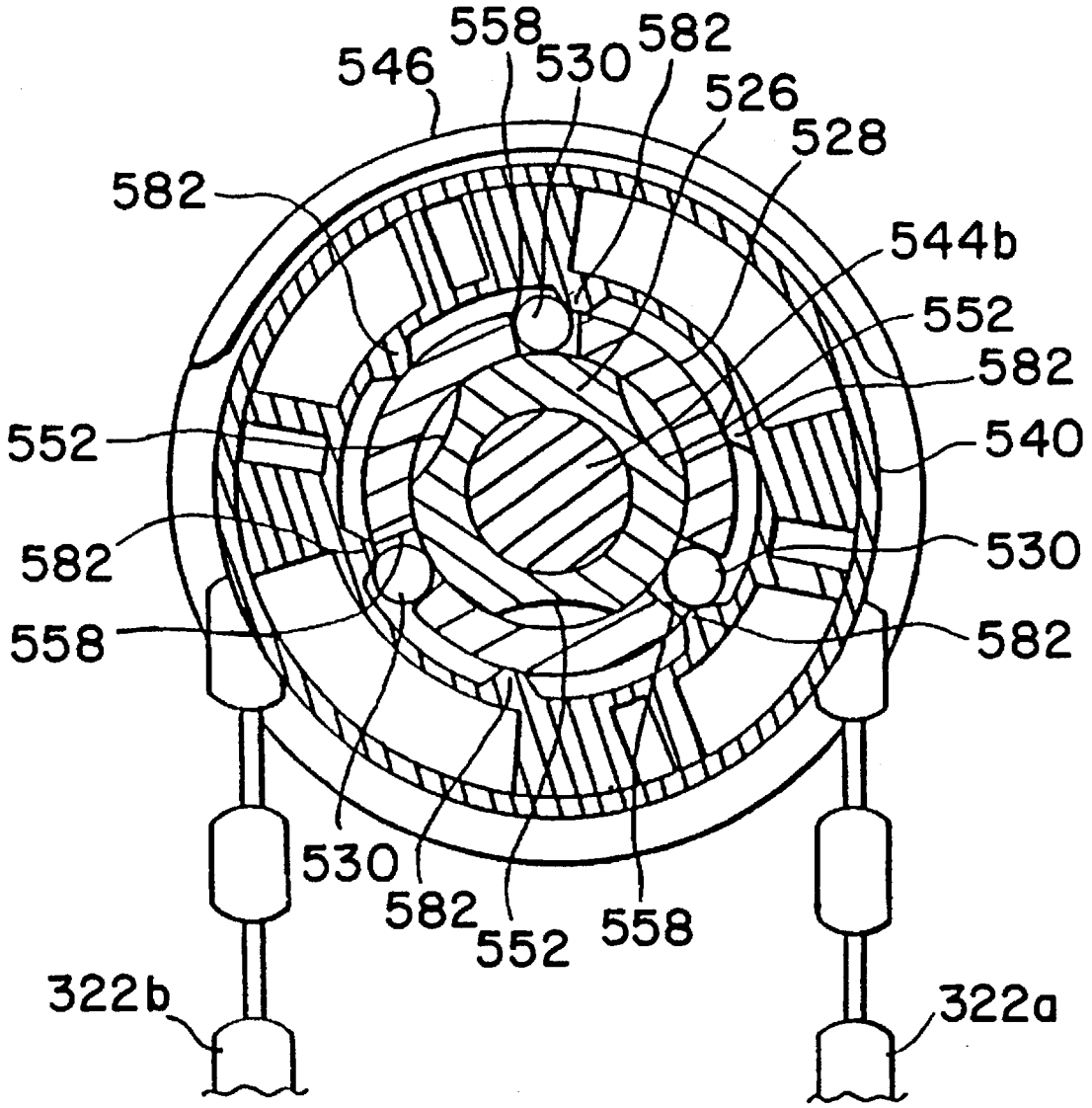
FIG. 31 is a cross section of the clutch unit in the fifth embodiment.

Now, the manner in which the roll screen apparatus works is described. When it is desired that the screen 318 is unwound from the stopping condition as shown in FIG. 31, the unwinding or "down" side 322*a* of the operation chain 322 is pulled down, thereby rotating the pulley 526 in the clockwise direction. As seen from FIG. 32, the longitudinal leg 560*a* of the clutch piece 528 abuts on the lower end of the arcuate aperture 554*b* of the pulley 526, and the longitudinal leg 560*c* of the clutch piece 528 abuts on the upper end of the arcuate aperture 554*a* of the pulley 526. Therefore, the pulley 526 and the clutch piece 528 rotate together as a whole, thereby causing the clutch piece 528 to rotate a predetermined angle with respect to the counter clutch piece 532 until their tapering projections 562 and 564 come to contact each other. At that very instant a pushing force is applied to the counter clutch piece 532 to couple these pieces together, permitting them to rotate as a whole. Then, the rotating force is applied to the counter clutch piece 532 in the unwinding direction to radially expand the unidirectional clutch spring 534, thereby decoupling the counter clutch piece 532 from the plug 540 to permit rotation of the counter clutch piece 532. Thus, the pulley 526, the clutch piece 528 and the counter clutch piece 532 rotate together as a whole. As the pulley 526 and the clutch piece 528 are coupled so as to rotate together, the engagement elements 530 stay on the outer circumference of the small-diameter circular section of the pulley 526 to appear party from the outer circumference of the clutch piece 528, thereby contacting selected radial projections 582 of the plug 540 to permit the plug 540 and hence, the screen winding pipe 316 to rotate along with the pulley 526. Thus, the screen-winding pipe 316 unwinds the screen 318.

Figure 32:
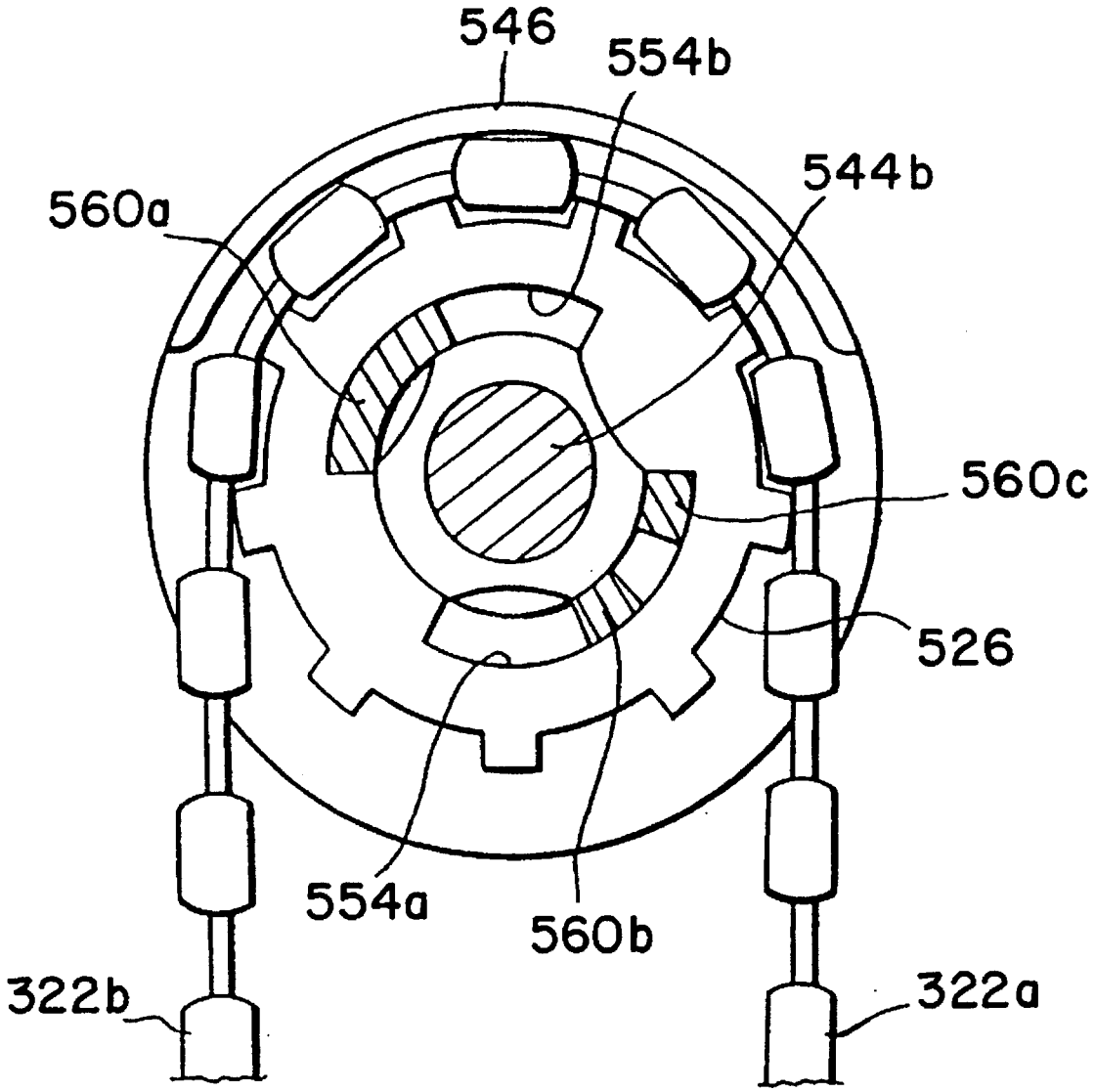
FIG. 32 is a cross section of the clutch unit in the fifth embodiment.

When it is desired that the unwinding of the screen 318 is made to stop, the hold on the unwinding or "down" side 322*a* of the operation chain 322 is lost, thereby stopping rotation of the pulley 526. As a result the screen-winding pipe 316 applies its winding resilient force to the screen 318 and the plug 540 for winding the screen 318 in the counter clockwise direction in FIG. 31. The selected radial projections 582 of of the plug 540 remain in contact with the engagement elements 530, thus causing the clutch piece 528 and the plug 540 to rotate together as a whole. The clutch piece 528 rotates the predetermined angle with respect to the counter clutch piece 532 so that their. tapering projections 562 and 564 come to contact. At that very instant a pushing force directed to the clutch spring holder 536 and a rotating force directed in the winding direction are applied to the counter clutch piece 532, as indicated by arrows in FIG. 30. Therefore, the unidirectional clutch spring 534 is tightened without allowing it to be caught by the joint space between the counter clutch piece 532 and the clutch spring holder 536. Thus, rotation of the counter clutch piece 532 is prevented, and hence, rotation of the clutch piece 528 is prevented. The plug 540 whose radial projections 582 abut on the engagement elements 530 cannot rotate, and therefore, the screen-winding pipe 316 stops in the condition as shown in FIGS. 31 and 32.

When it is desired that the screen 318 is wound, starting from the position as shown in FIG. 31, the winding or "up" side 322*b* of the operation chain 322 is pulled down to rotate the pulley 526 somewhat in the counter clockwise direction in FIG. 31. Then, the pulley 526 rotates with respect to the clutch piece 528 until the longitudinal legs 560*a* and 560*b* of the clutch piece 528 come to contact the upper end of the arcuate aperture 554*b* and the lower end of the arcuate aperture 54*a* of the pulley 526. Then, the curved recesses 552 of the pulley 526 are put in alignment with the longitudinal spaces 558 of the clutch piece 528 with the result that the engagement elements 530 move inward from the position in which these engagement elements 530 pushed radially outward until they are accommodated in the curved recesses 552 of the pulley 526, thereby disconnecting the clutch piece 528 from the plug 540. Thus, the plug 540 is put in condition for free rotation. Therefore, even if the pulling-down of the "up" side 322*b* of the operation chain 322 stops by losing the hold on the chain 322, the screen-winding pipe 316 can rotate under the influence of the winding spring in the counter clockwise direction in FIG. 33 to wind up the screen 318.

Figure 33:
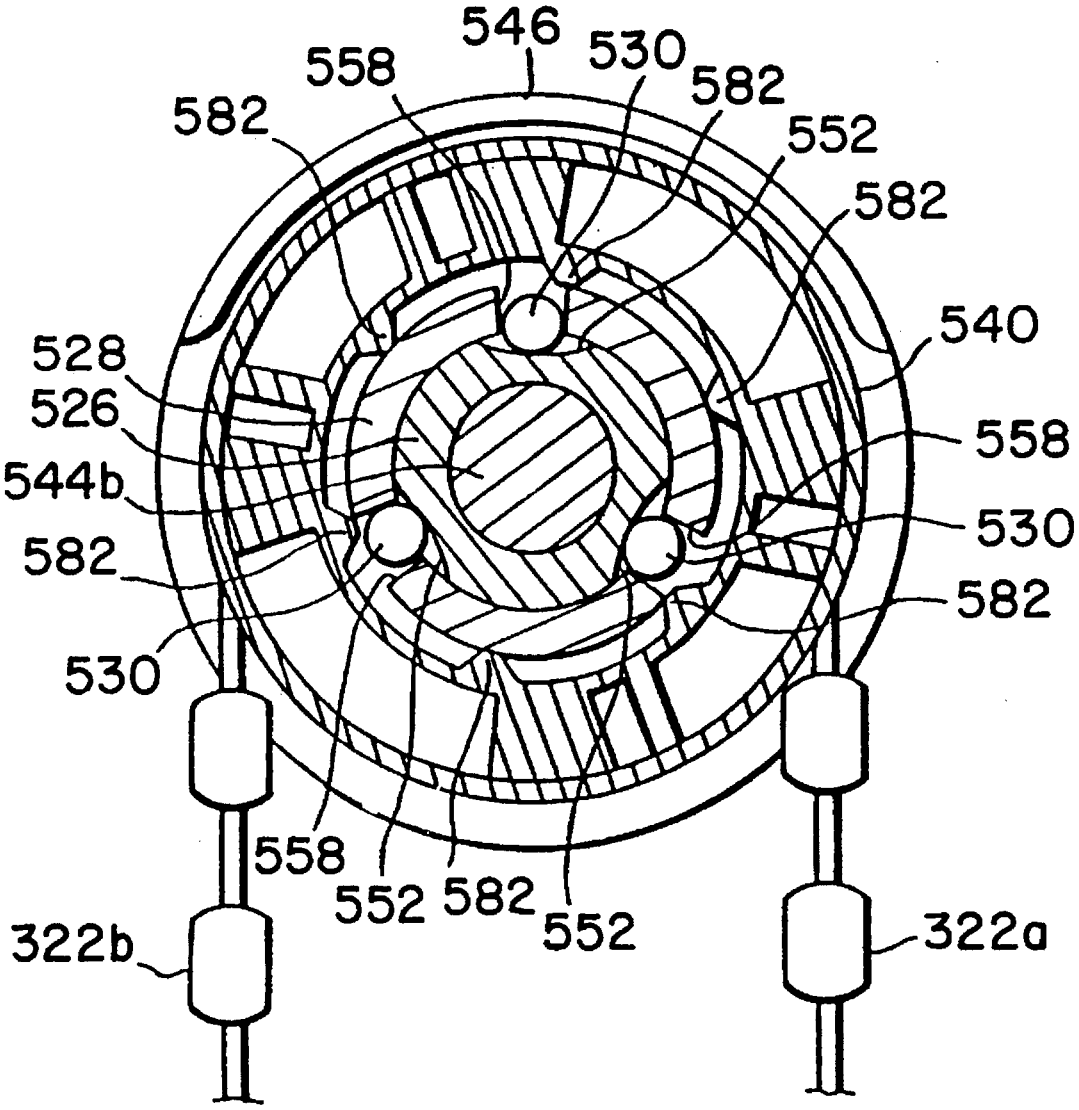
FIG. 33 is similar to FIG. 31, but showing how selected parts work in the screen-winding condition.
Figure 34:
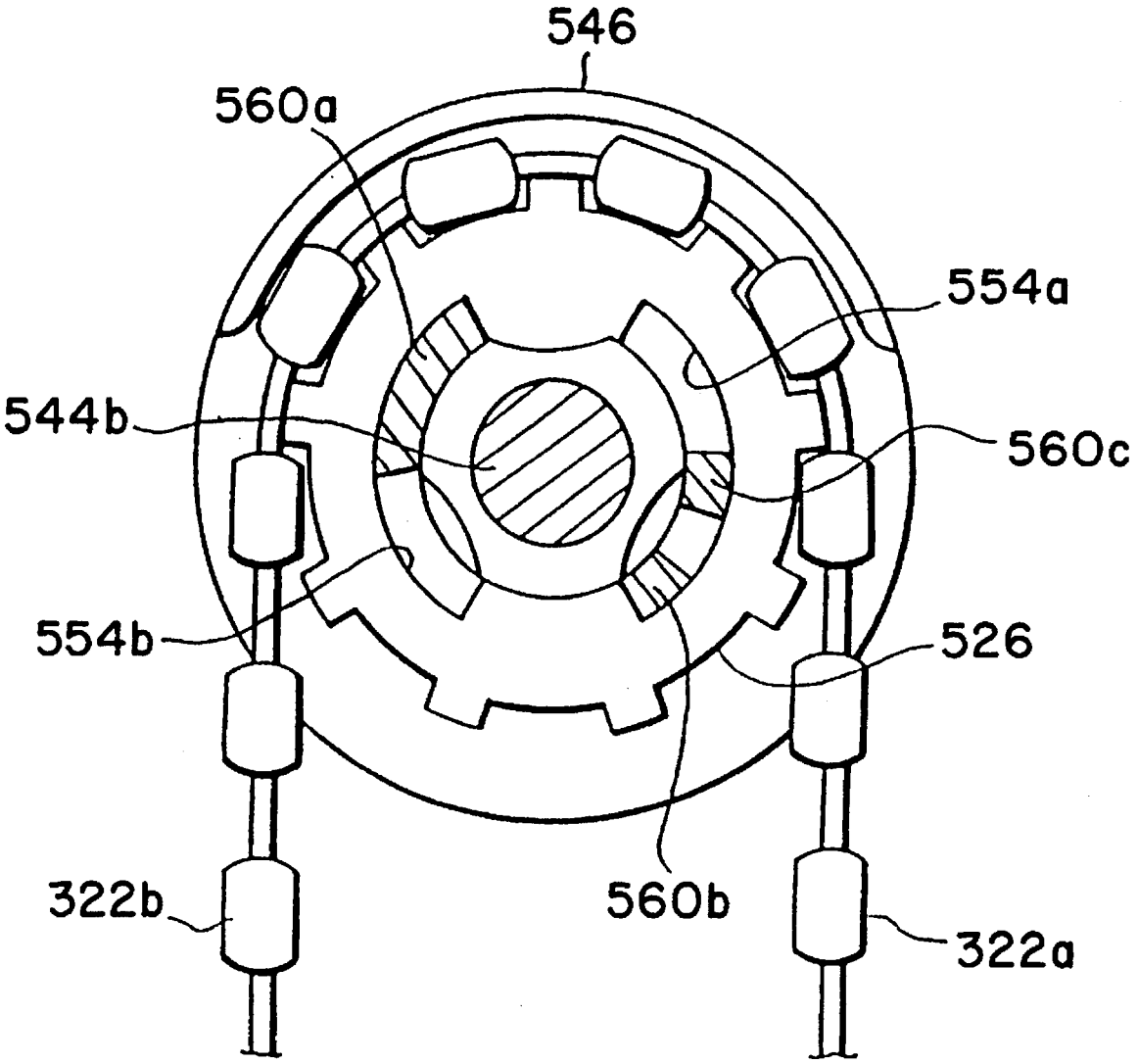
FIG. 34 is similar to FIG. 32, but showing how selected parts work in the screen-winding condition.

Finally, when it is desired that the screen 318 stops in the course of winding, the unwinding or "down" side 322*a* of the operation chain 322 is pulled down to rotate the pulley 526 clockwise in FIG. 33. Then, the pulley 526 rotates with respect to the clutch piece 528 until the longitudinal legs 560*a* and 560*c* of the clutch piece 528 come to contact the lower end of the arcuate aperture 554*b* and the upper end of the arcuate aperture 554*a* of the pulley 526, as seen from FIG. 32. As a result, the engagement elements 530 are driven upward by the slopes of the curved recesses 552 until these engagement elements 530 come to partly appear from the outer circumference of the clutch piece 528, thus permitting them to come to contact selected radial projections 582 of the plug 540 if these radial projections 582 come close to the engagement elements 530, as seen from FIG. 31. On the other hand, the plug 540 along with the screen-winding pipe 316 rotate under the influence of the winding spring in the counter clockwise direction in FIG. 31, and therefore, selected radial projections 582 of the plug 40 come to contact the engagement elements 530, thus connecting the plug 40 and the clutch piece 528 for rotating together as a whole. Just when the clutch piece 528 along with the plug 540 rotate counter clockwise in FIG. 31, a pushing force directed to the clutch spring holders 536 and a rotating force directed in the winding direction are applied to the counter clutch piece 532. Therefore, the unidirectional clutch spring 534 tightens to connect the counter clutch piece 532 to the clutch spring holder 536 without allowing a part of the clutch spring 534 to be caught by the join between the counter clutch piece 532 and the clutch spring holder 536. Thus, rotation of the clutch piece 528 is prevented, and hence, rotation of the plug 540 is prevented. Then, the screen-winding pipe 316 stops.

OPERATION OF THE THIRD, FORTH, AND FIFTH EMBODIMENTS

When it is desired that the wound screen is unwound, the unwinding or "down" side of the cord running around the pulley is pulled down, thereby causing the pulley to rotate in the unwinding direction in which the screen-winding pipe unwinds the wound-up screen. Then, the pulley rotates a predetermined angle with respect to the rotational cylinder, allowing the engagement members to get in the coupling position in which the rotational cylinder is coupled with the plug. After rotating the predetermined angle, the pulley is connected to the rotational cylinder, thus permitting them to rotate as a whole to cause the unidirectional clutch spring to radially expand by applying thereto a loosing force in the screen-unwinding direction, thereby putting the rotational cylinder in the rotational condition. Thus, rotation of the pulley can be transmitted to the screen-winding pipe via the rotational cylinder and the engagement members. The wound screen can be unwound to its full length by pulling down the cord and rotating the pulley without intermission.

When it is desired that the unwinding of the wound screen is made to stop or that the screen is kept extensive to its full length, rotation of the pulley is made to stop by losing the hold on the cord by hand, thereby allowing the screen-winding pipe and the plug to rotate in the screen-winding direction under the influence of resilient bias. The plug remains integral with the rotational cylinder with the engagement members intervening between the plug and the rotational cylinder, and therefore, the rotational cylinder along with the pulley rotate in the screen-winding direction, thereby allowing the rotational cylinder to apply a tightening force to the unidirectional clutch in the screen-winding direction until the rotational cylinder is prevented from rotating. As a result, the plug and hence the screen-winding pipe are prevented from rotating.

When it is desired that the screen is wound up, the winding or "up" side of the cord is pulled down somewhat, thereby causing the pulley to rotate in the winding direction in which the screen-winding pipe winds the screen. Accordingly, the rotational cylinder rotates so as to allow the engagement members to shift to the decoupling position in which the rotational cylinder is disconnected from the plug. Thus, the plug and the screen-winding pipe are put in the rotational condition, thus allowing the pipe to rotate and wind up the screen under the influence of resilient force, not requiring a hold on the cord by hand.

When it is desired that the screen is made to stop in the course of winding, the unwinding or "down" side of the cord is pulled down somewhat, thereby causing the pulley to rotate in the unwinding direction in which the screen-winding pipe unwinds the screen. Accordingly, the rotational cylinder rotates so as to allow the engagement members to shift to the coupling position in which the rotational cylinder is connected to the plug. Thus, the rotational cylinder is urged to rotate in the screen-winding direction, thereby applying a tightening force to the unidirectional clutch in the screen-winding direction to cause the clutch spring to radially reduce, thereby seizing and fixing the rotational cylinder to the stationary axle to put it in non-rotational condition. Therefore, the plug and hence the screen-winding pipe are prevented from rotating, and the winding-up of the screen is made to stop.

As may be understood from the above, the unwinding of the screen can be continued to the end by pulling the cord all the time. Likewise, the winding-up of the screen can be continued to the end by pulling the cord down somewhat, and losing the hold on the cord by hand. The screen can be kept extensive to its full extent at the termination of unwinding or can be made to stop in the course of unwinding simply by losing the hold on the cord. Finally, the screen can be made to stop in the course of winding-up by pulling down somewhat the unwinding or "down" side of the cord and by losing the hold on the cord. Thus, the winding-up and unwinding-down.

What is claimed is:

1. A roll screen apparatus including a screen-winding pipe rotatably supported at both ends by opposite side plates of a frame, with an upper side of a screen being connected to the pipe for winding and unwinding, a winding spring for applying a force to the screen-winding pipe to rotate it in a direction in which the screen is wound up thereon, and a clutch device arranged to permit transmission of the rotating force of an associated pulley through an operation cord and transmit the resilient force of the winding spring, characterized in that the clutch device comprises:

a stationary axle unrotatably mounted to the side plates;

a plug rotatably supported relative to the stationary axle, and connected to the screen-winding pipe so as to rotate together with the pipe, wherein said pulley is rotatably fitted relative to the stationary axle;

a rotational cylinder connectable to the pulley so as to rotate together with the pulley, but rotatable a predetermined counterwise angle;

an engagement member for one of connecting and disconnecting between the rotational cylinder and the plug depending on the direction of rotation of the pulley relative to the rotational cylinder; and an unidirectional clutch spring to one of engage and disengage the rotational cylinder to the stationary axle depending on the direction of rotation of the rotational cylinder.

* * * * *